US012649608B2

(12) United States Patent
Dejans

(10) Patent No.: US 12,649,608 B2
(45) Date of Patent: Jun. 9, 2026

(54) REUSABLE TRANSPORT CONTAINER WITH A LATERAL WALL WITH AN ORIENTATION SENSOR

(71) Applicant: Schoeller Allibert GmbH, Schwerin (DE)

(72) Inventor: Frederik Dejans, Lendelede (BE)

(73) Assignee: Schoeller Allibert GmbH, Schwerin (DE)

( * ) Notice: Subject to any disclaimer, the term of this patent is extended or adjusted under 35 U.S.C. 154(b) by 0 days.

(21) Appl. No.: 18/723,970

(22) PCT Filed: Jan. 2, 2023

(86) PCT No.: PCT/EP2023/050019
§ 371 (c)(1),
(2) Date: Jun. 25, 2024

(87) PCT Pub. No.: WO2023/126538
PCT Pub. Date: Jul. 6, 2023

(65) Prior Publication Data

US 2025/0100745 A1 Mar. 27, 2025

(30) Foreign Application Priority Data

Jan. 3, 2022 (EP) ..... 22150077

(51) Int. Cl.
*B65D 19/38* (2006.01)
*B65D 19/18* (2006.01)
*B65D 25/00* (2006.01)

(52) U.S. Cl.
CPC ..... *B65D 19/38* (2013.01); *B65D 19/18* (2013.01); *B65D 25/005* (2013.01);
(Continued)

(58) Field of Classification Search
CPC ..... B65D 19/38; B65D 25/005; B65D 2519/00069; B65D 2519/00174;
(Continued)

(56) References Cited

U.S. PATENT DOCUMENTS 6,820,761 B1 * 11/2004 Mouri ..... B65D 11/1833 206/600
10,408,489 B1 * 9/2019 Trishaun ..... H04Q 9/00
(Continued)

FOREIGN PATENT DOCUMENTS

CN 108088504 A 5/2018
KR 1020190138050 A 12/2019
WO WO-2010007621 A1 * 1/2010 ..... B65D 19/38

OTHER PUBLICATIONS

Search Report received in European Application No. 22150077.0-1014 dated May 3, 2022, with translation, 12 pages.
(Continued)

*Primary Examiner* — Rafael A Ortiz
(74) *Attorney, Agent, or Firm* — Christopher A. Rothe; CM Law

(57) ABSTRACT

A reusable transport container includes a base and foldable and/or collapsible side panel sections arranged on the base. The side panel sections can be brought into an upright position in which the side panel sections are substantially perpendicular to the base, and into a non-upright position in which the side panel sections are folded or collapsed. The reusable transport container includes a sensor configured to distinguish between the upright position and the non-upright position of at least one side panel section, and a transmitting device coupled to or integrated in the sensor configured to output different signals corresponding to the position detected by the sensor.

18 Claims, 18 Drawing Sheets

(52) U.S. Cl.
CPC ..... *B65D 2519/00069* (2013.01); *B65D 2519/00174* (2013.01); *B65D 2519/00333* (2013.01); *B65D 2519/00502* (2013.01); *B65D 2519/00587* (2013.01); *B65D 2519/00646* (2013.01); *B65D 2519/009* (2013.01)

(58) Field of Classification Search
CPC ..... B65D 2519/00333; B65D 2519/00502; B65D 2519/00587; B65D 19/009; B65D 2519/00646; B65D 19/18
USPC ..... 206/600, 386
See application file for complete search history.

(56) References Cited

U.S. PATENT DOCUMENTS

| | | | | |
|---|---|---|---|---|
| 10,968,012 | B1 * | 4/2021 | Ward | B65D 11/1833 |
| 11,066,210 | B1 * | 7/2021 | Ankele | B65D 19/42 |
| 11,084,623 | B1 * | 8/2021 | Ankele | B65D 19/18 |
| 2004/0238400 | A1 * | 12/2004 | Knutsson | B65D 11/1833 206/600 |
| 2017/0206495 | A1 | 7/2017 | Ratkovich et al. | |
| 2018/0102795 | A1 | 4/2018 | Liao et al. | |
| 2020/0118065 | A1 * | 4/2020 | Li | H04B 1/034 |

OTHER PUBLICATIONS

Search Report received in International Application No. PCT/EP2023/050019 dated Apr. 20, 2023, with translation, 7 pages.
Written Opinion received in International Application No. PCT/EP2023/050019 dated Apr. 20, 2023, with translation, 13 pages.

* cited by examiner

REUSABLE TRANSPORT CONTAINER WITH A LATERAL WALL WITH AN ORIENTATION SENSOR

CROSS-REFERENCE TO RELATED APPLICATIONS

This application is the United States national phase entry of International Application No. PCT/EP2023/050019, filed on Jan. 2, 2023, and claims priority to European Application No. 22150077.0, filed on Jan. 3, 2022. The contents of International Application No. PCT/EP2023/050019 and European Application No. 22150077.0 are incorporated by reference herein in their entireties.

FIELD

The present invention relates to a reusable transport container having folding and/or collapsible side panels or side panel sections, which can be brought into an upright position in which the side panels are substantially perpendicular to the ground, and into a non-upright position in which the side panels are folded or collapsed.

BACKGROUND

Reusable transport containers are applied in many areas of industry and logistics. Apart from reusable transport containers having rigid side panels, there are also those having folding and/or collapsible side panels.

Reusable transport containers of this type having folding and/or collapsible side panels offer the advantage over reusable transport containers having rigid side panels that, when empty, they can be stored and transported in a space-saving manner, which results in reduced storage and transport costs.

In order to ensure maximum possible utilization of the reusable transport containers and in this way to minimize logistics costs, it is necessary that it is known at any time how many of the reusable transport containers are still storing/stored and how many reusable transport containers are currently in use. For this purpose, it is currently necessary that a staff member, such as a warehouse clerk, manually books the reusable transport containers into and out of a system.

Such manual booking creates additional effort and increases the labor cost. In addition, it offers an error source which may result in the fact that there are no reusable transport containers in stock, although this is stored correspondingly in the system. This can result in delays in production cycles and, consequently, in considerable costs.

SUMMARY

Therefore, it is the object of the present invention to provide an option which eliminates or at least reduces the above-mentioned drawbacks. Concretely, it is an object of the present invention to provide an option to ensure automatic checking as to how many reusable transport containers are in stock and how many reusable transport containers are in circulation, and in particular to be able to determine the current state of a reusable transport container.

Concretely, the object is achieved by a reusable transport container having a base and folding and/or collapsible side panel sections arranged on the base which can be brought into an upright position in which the side panel sections are substantially perpendicular to the base, and into a non-upright position in which the side panel sections are folded or collapsed. The reusable transport container further includes at least one sensor configured to distinguish between the upright position and the non-upright position of at least one side panel section. Furthermore, the reusable transport container includes a transmitting device coupled to or integrated in the at least one sensor which is configured to output different signals corresponding to the position detected by the sensor.

In other words, the reusable transport container includes the base and side panel sections articulated to the base. The side panel sections are designed to be folded relative to the base by means of hinges. A first folding end position constitutes the upright position in which an angle between the base and the side panel sections is substantially 90°. When all side panel sections are in the first folding end position, the reusable transport container is in a state in which it can receive material. A second folding end position constitutes the non-upright position in which the side panel sections are preferably arranged substantially in parallel to the base. When all side panel sections are in the second folding end position, the reusable transport container is in a state in which it can be transported and/or stored in a space-saving manner. The reusable transport container includes the sensor, the sensor detecting whether the at least one side panel section is in the first folding end position or in the second folding end position. The sensor is provided with or coupled to the transmitting device. The transmitting device is designed to output the state of the reusable transport container detected by the sensor as the signal. Preferably, the signal has at least two signal states, a first signal state indicating the first folding end position and a second signal state indicating the second folding end position.

The reusable transport container can have more than one sensor, where it can be advantageous if the reusable transport container has one sensor for each side panel section.

Accordingly, it is the gist of the invention to design the reusable transport container with the folding and/or collapsible side panel sections including the sensor, the sensor detecting whether the side panel sections are in a folded or unfolded state.

In this way, it can be recognized by means of the signal whether the reusable transport container is in the non-upright position and consequently in stock, or in the upright position and consequently in use. This makes it easy to query a number of reusable transport container in stock without a staff member having to manage this manually in a system. In this way, on the one hand labor costs can be reduced and, on the other hand, a risk of erroneous stocks of reusable transport container being stored in the system can be minimized.

In a first aspect, the sensor can be a position sensor configured in and/or on the at least one side panel section.

In other words, the at least one side panel section can be designed to include the sensor which is the position sensor. Accordingly, the sensor can be tightly connected to the side panel section. In other words, the sensor and the side panel section can be connected so that the orientation of the sensor in a mounted state corresponds to the orientation of the side panel section.

The sensor detects, as the position sensor, the orientation of the side panel section. Accordingly, a first orientation is associated with the upright position and a second orientation is associated with the non-upright position. In this way, the sensor as position sensor can distinguish between the upright position and, thus, the first folding end position, and the non-upright position and, thus the second folding end position. A position sensor or tilt sensor is an active sensor which can detect its position/orientation independently with reference to the gravity field of the earth.

In another aspect, the orientations of the position sensor in the upright position of the at least one side panel section and in the non-upright position of the at least one side panel section can be different by approx. 90°.

In other words, the upright position of the at least one side panel section can differ by approx. 90° from the non-upright position of the at least one side panel section. Since the at least one side panel section and the position sensor can be tightly interconnected, the change of orientation of the side panel section corresponds to the change of orientation of the position sensor.

The clear distinction of the upright position from the non-upright position of the side panel sections or, resp., of the at least one side panel section ensures reliable state detection by the orientation sensor.

In another aspect, the sensor can be received completely and without any protrusion in the side panel section.

In other words, the sensor can be integrated in the side panel section so that the dimensions of the side panel section are not changed.

The complete integration of the sensor into the side panel section helps fold and/or collapse the side panel sections without the folding and/or collapsing being impeded by a protrusion caused by the sensor. In addition, the complete integration minimizes a risk of damage of the sensor.

In another aspect, the side panel sections and, resp., the side panels can be designed to be double-paneled as a double panel. The at least one side panel section including the sensor can include a sensor holder inside the double panel which is configured to hold the sensor.

In other words, the side panel sections and, resp., the side panels can feature a sandwich design which can comprise a first cover layer and a second cover layer which are connected by means of a support structure. In the support structure, the sensor holder can be formed between the first cover layer and the second cover layer. The sensor holder can be designed as an insertion that mounts the sensor in the form of the position sensor.

By designing the side panel section as a double panel, the sensor holder can be formed with simple tools at low cost.

In another aspect, an opening of the sensor holder can be formed at a narrow edge of the side panel section. The narrow edge is understood to be one of the edges which are not the cover layers of the double panel and which are preferably oriented substantially normal to the first cover layer and the second cover layer.

In another aspect, the opening of the sensor holder can be formed at a hinge edge of the side panel section.

In other words, the sensor holder includes the (preferably only) opening which is tailored to the dimensions of the sensor. The opening is formed at the hinge edge of the side panel section. The hinge edge is understood to be the edge of the side panel section which in the state when the side panel sections are in the upright position faces the base. In other words, in the upright position the hinge edge is oriented substantially in parallel to the base. In yet other words, the hinge edge is the edge of the side panel section which, in the upright position, is arranged most distant from the reusable transport container opening. Preferably, the opening can be closed by the base in the upright position.

Such orientation of the opening can help prevent the sensor from being inadvertently removed or falling out. In addition, the sensor can be efficiently protected against damage in this way.

In another aspect, a material thickness of the double panel, specifically a material thickness of cover layers of the double panel, can be reduced in an area of the sensor holder.

In other words, the cover layers of the double panel of the side panel section can be designed to be thinner in the area of the sensor holder than in a remaining panel area of the side panel sections.

Responsiveness and communication capability, resp., of the sensor can be increased by reducing the panel thickness. Further, the transmission power of the sensor and the transmitting device, resp., can be reduced without reducing a communication radius. In this way, the energy consumption of the sensor can be efficiently reduced.

In another aspect, in the area of the sensor holder at least one through-hole can be formed in the cover layer of the double panel. The at least one through-hole is configured so that the sensor cannot fall out of or be removed from the sensor holder through the through-hole.

It is a further object of the present invention to fasten a sensor in and/or on the reusable transport container.

This object is achieved by the reusable transport container comprising the base and folding and/or collapsible side panel sections arranged on the latter which can be brought into the upright position in which the side panel sections are substantially perpendicular to the base, and into the non-upright position in which the side panel sections are folded or collapsed. The reusable transport container includes the sensor that is configured to distinguish between the upright position and the non-upright position of at least one side panel section, the sensor being fixed in the sensor holder by means of an adapter. Furthermore, the reusable transport container includes the transmitting device coupled to or integrated in the at least one sensor which is configured to output different signals corresponding to the position detected by the sensor.

In other words, the sensor can be fixed in the sensor holder by means of an adapter.

In yet other words, the adapter can be provided and designed to mount the sensor by force fit and/or form fit and/or material fit. A resulting sensor-adapter unit can be inserted in the sensor holder of the reusable transport container.

The adapter ensures easy mounting of the sensor. Additionally, the adapter can be adjusted flexibly to different sensors of different dimensions without the reusable transport container and, resp., the sensor holder of the reusable transport container having to be adjusted. It is possible in this way to save costs, as, when a sensor model of differing dimensions is replaced, exclusively the adapter and not the whole reusable transport container including the sensor holder has to be adjusted. In this way, tool costs can be saved.

In one aspect, the adapter can include a positioning aid by which the adapter can be inserted into the sensor holder in exclusively one defined inserting orientation.

In other words, the adapter can comprise the positioning aid the geometry of which ensures that the adapter can be inserted into the sensor holder in exactly one orientation. In yet other words, the adapter can be designed according to the Poka Yoke principle.

Providing a positioning aid on the adapter ensures that the sensor can be inserted into the sensor holder exclusively in the defined inserting orientation. This can efficiently prevent the sensor from being inserted in a misorientation which may result in erroneous signals of the sensor.

In another aspect, the adapter can positively lock, preferably reversibly, in the sensor holder of the at least one side panel section.

In other words, the adapter can be designed with locking lugs or locking hooks which lock in dedicated projections of the sensor holder. The locking lugs or locking hooks can be preferably elastic and/or resilient.

By fixing the adapter in the sensor holder by locking lugs or locking hooks, insertion of the sensor into the sensor holder without tools is safeguarded, which reduces assembly effort. In the case of reversible locking, the sensor and, resp., the adapter including the sensor contained therein can be released from the sensor holder for purposes of maintenance and/or repair in particular non-destructively and without damaging the reusable transport container or the adapter.

The object to fasten the sensor in and/or on the reusable transport container is furthermore also achieved by a reusable transport container comprising a base and folding and/or collapsible side panel sections arranged on the base which can be brought into the upright position in which the side panel sections are substantially perpendicular to the base, and into the non-upright position in which the side panel sections are folded or collapsed. The reusable transport container includes the sensor that is configured to distinguish between the upright position and the non-upright position of at least one side panel section, the sensor being fastened by at least one fastener to the at least one side panel section. In addition, the reusable transport container includes the transmitting device coupled to or integrated in the at least one sensor which is configured to output different signals corresponding to the position detected by the sensor.

In other words, the sensor can be fastened by at least one fastener to the at least one side panel section.

In yet other words, the sensor can be fixed, preferably on reinforcing elements of the side panel section, to the side panel section, specifically to a surface of the side panel section, using at least one fastener, such as in the form of screws, rivets, adhesive, at least one fixing bracket or the like.

By fixing the sensor to the side panel section, specifically to the surface of the side panel section, the sensor can be easily mounted and dismounted. In particular, in such a configuration the sensor can be accessed even in a state in which the side panel sections of the reusable transport container are in the upright position.

In one aspect, the side panel section can have at least a holding geometry that is provided and designed to hold the sensor in exactly a particular orientation.

In other words, the side panel section can be configured so that the sensor can be fastened to the side panel section exclusively in the particular orientation. In yet other words, the holding geometry can be designed according to the Poka Yoke principle.

The holding geometry can help prevent the sensor from being fastened to the side panel section in an orientation deviating from the particular orientation and prevent the sensor from outputting erroneous signals.

The object of fastening the sensor in and/or on the reusable transport container is also achieved by a reusable transport container comprising a base and folding and/or collapsible side panel sections arranged on the base which can be brought into the upright position in which the side panel sections are substantially perpendicular to the base, and into the non-upright position in which the side panel sections are folded or collapsed. The reusable transport container includes the sensor that is configured to distinguish between the upright position and the non-upright position of at least one side panel section, wherein the sensor holder is closed by a lid and the lid in a mounted state is flush with the side panel section. Furthermore, the reusable transport container includes the transmitting device coupled to or integrated in the at least one sensor which is configured to output different signals corresponding to the position detected by the sensor.

In other words, the sensor holder can be closed by a lid, in a mounted state the lid being flush with the side panel section.

In yet other words, the sensor holder can be accessible through one of the surfaces of the side panel section and can be closed by the lid. Explicitly, each of the surfaces of the side panel section can be designed as the surface that holds the lid. When the lid is mounted on the sensor holder, the area consisting of the surface of the side panel section and the lid is a planar surface. For example, the lid can be formed on one of the cover layers of the side panel section. Alternatively, the lid can also be formed at the hinge edge of the side panel section.

The sensor can be protected against environmental influences by the sensor holder being closed. The flat design does not hinder folding or collapsing of the side panel sections.

In another aspect that can be applied to all described variants and aspects, respectively, the sensor holder can be designed to be fluid-tight against an interior of the at least one side panel section preferably inside the double panel.

In other words, the sensor holder can be connected exclusively to an environment surrounding the reusable transport container and can be closed to the interior of the preferably double-paneled side panel section surrounding the sensor holder.

It can be ensured in this way that fluid, such as water when the reusable transport container is cleaned, does not penetrate into the interior of the side panel section through the sensor holder. This prevents an undesired increase in the weight of the reusable transport container due to the fluid, sloshing movements during a transport and a potential unpleasant odor which might be created by the fluid.

In another aspect that is applicable independently of the way of fastening the sensor, the sensor can be provided with an energy storage.

In other words, the sensor can include an energy storage or can be connected to an energy storage. Preferably, the energy storage can be a rechargeable energy storage, such as in the form of an accumulator. Further preferably, a charging device, preferably in the form of a charging plug or a charging connector, of the energy storage can be arranged so that the energy storage can be charged without the sensor having to be removed from the sensor holder.

By providing an energy storage, the reusable transport container can be moved and positioned freely without a static energy supply, such as in the form of a cable, having to be considered.

In another aspect that is applicable independently of the way of fastening the sensor, the sensor can be designed with a wireless communication module.

In other words, the sensor can have a wireless communication module or can be connected to a wireless communication module. The wireless communication module can replace or be connected downstream of the transmitting device. The wireless communication module can be provided and designed to wirelessly communicate the position detected by the sensor and/or the signal output by the transmitting device. Accordingly, all common types of wireless communication can be used. Examples of possible wireless types of communication are Bluetooth, IEEE 802.11 mobile communications or the like.

The wireless communication module can help transmit wirelessly the position detected by the sensor so that the reusable transport container can be moved and positioned freely.

In another aspect that is applicable independently of the way of fastening the sensor, the transmitting device can be designed in the form of the wireless communication module separately from the sensor in the base of the reusable transport container in a communication module holder.

As an alternative, the communication module can be designed in a stand or skid of the reusable transport container. The stand or skid can be part of the base. Preferably, the communication module can be insertable through an opening oriented toward a base of the reusable transport container by an adapter, a flap or in any other suitable manner.

Such a design allows the communication module to be well protected in a larger space. Further, a larger energy storage can be formed at/in the communication module than this would be possible in the side panel thinner as compared to the base. Moreover, by accommodating the communication module and the sensor separately, the technology according to the invention can be applied in reusable transport containers in which this would not be possible, if the sensor and the communication module were combined, for reasons of space. The opening toward a base can help prevent or at least impede manipulation of the communication module.

In a further aspect, the sensor can wirelessly transmit the detected orientation to the communication module. Concretely, the communication module can query the orientation detected by the sensor at predetermined intervals (in this case, the sensor detects actively its orientation, but transmits passively the detected orientation). As an alternative, the sensor can actively transmit the detected orientation to the communication module at the predetermined intervals.

In one aspect, the communication between the sensor and the communication module can take place via Bluetooth.

In particular for passive transmission of the orientation of the sensor to the communication module, the sensor is very compact and long-lasting as there a low power consumption by the sensor.

In another aspect, the sensor and the communication module can be coupled/paired wirelessly. In other words, the sensor and the communication module can be configured so that the sensor communicates exclusively with the related/coupled communication module. In yet other words, the sensor and the communication module are programmed, preferably before being installed, such that the communication module detects exclusively transmitted orientations/orientation data of the coupled sensor as being related.

In this way, it can be ensured that in particular in a warehouse where a plurality of reusable transport containers are stored side by side, exclusively the sensor and the communication module of one single reusable transport container communicate with each other and there is no (undesired) communication of the sensor of a first one of the reusable transport containers with the communication module of a second one of the reusable transport containers, which might result in wrong stocks and in production losses.

In another aspect, exactly one of the communication modules and more than one of the sensors can be formed in the reusable transport containers, wherein all sensors in the reusable transport container communicate with the communication module. Preferably, one of the sensors can be formed in each side panel of the reusable transport container or in a defined number of side panels of the reusable transport container.

Such a redundant design can prevent an incorrectly detected state of the reusable transport container from occurring.

In another aspect, in addition to the sensor in the side panel, a sensor can be formed in the base of the reusable transport container.

In this way, tilting/falling of the reusable transport container can be distinguished from collapsing of the reusable transport container.

In another aspect that is applicable independently of the way of fastening the sensor, the sensor can communicate a detected position to an external device by means of the communication module.

In other words, the communication module can send the detected position wirelessly to an external device by means of a (radio) signal, the device preferably being a server. The device can preferably determine based on the transmitted signal how many reusable transport containers are in a storing state and how many of the reusable transport containers are in a filled state.

In another aspect that is applicable independently of the way of fastening the sensor, the detected position can be communicated to the external device at a defined interval. Alternatively, the detected position can be transmitted to the external device only when the external device outputs a query/trigger.

In other words, the wireless communication module can communicate the detected position to the external device at a defined time interval. For example, the wireless communication module can communicate the detected position to the external device every 30 seconds, every ten minutes or every two hours.

Energy can be saved by sending the detected position at defined intervals, which ensures that the sensor can work independently for a longer period of time without maintenance. The interval can be tailored to the intended use and the operating environment of the reusable transport container.

In another aspect that is applicable independently of the way of fastening the sensor, the sensor can be arranged in a third of the at least one side panel section facing the base in which the sensor is formed.

In an alternative aspect of the present invention, a position sensor is used in a reusable transport container to establish a storage state/a filling state/a filling/a stock level of the reusable transport container.

In other words, the position sensor is used to establish whether the side panels or, resp., the at least one side panel of the reusable transport container is in the upright position or in the non-upright position. Then, it can be determined from said established value of the position sensor in which state the reusable transport container is and if it is available for logistics, for example.

DETAILED DESCRIPTION

In the following, embodiments of the present invention will be described based on the related Figures.

First, based on FIG. 1 to FIG. 4, a reusable transport container 2 according to the invention is described in a general embodiment.

Figure 1:
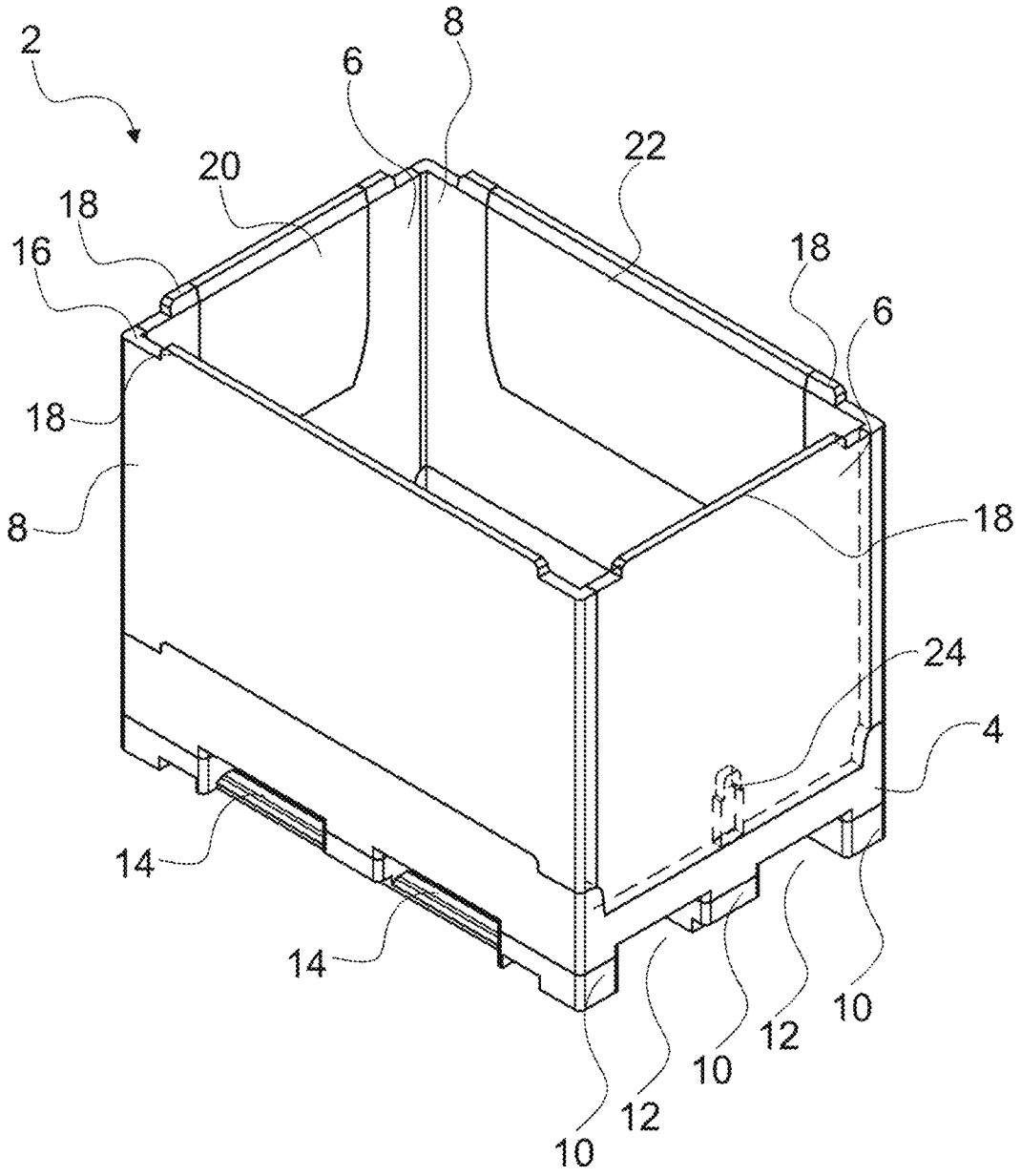
FIG. 1 is a perspective view of a first embodiment of a reusable transport container according to the invention having side panels in an upright position.

FIG. 1 illustrates the reusable transport container 2 according to the invention, specifically made of plastic, of a first embodiment comprising a rectangular base 4 and two first short side panels 6 and second long side panels 8 each being articulated by hinges to the base 4. The first short side panels 6 are hinged to short sides of the base 4. The second long side panels 8 are hinged to long sides of the base 4. In an upright position, the first side panels 6 and the second side panels 8 extend substantially perpendicularly away from the base 4. The first side panels 6 and the second side panels 8 preferably are double-paneled first and, resp., second side panels 6, 8. In other words, the first side panels 6 and the second side panels 8 preferably include, in a double-paneled embodiment, two cover surfaces and a support structure which connects the two cover surfaces.

The base includes stand skids 10 aligned/oriented in the direction of the long side of the base 4. First fork openings 12 are formed between the stand skids 10. The first fork openings 12 are configured so that the reusable transport container 2 can be received and transported by means of a forklift, a lifting truck or the like. Second fork openings 14 are formed at the long sides of the base 4.

An opening rim 16 is formed on a side of the first side panels 6 and the second side panels 8 remote from the base 4. The opening rim 16 encloses an opening of the reusable transport container 2. At the opening rim 16 locking edges 18 are formed which extend from the opening rim 16 in a direction away from the base 4. The locking edges 18 enable plural identical reusable transport containers 2 to be stacked in a shift-safe manner.

A first small flap 20 is formed centrally in one of the first side panels 6. The first flap 20 extends from the opening rim 16 approximately over half the height of the first side panel 6. The first flap 20 is hinged to an edge oriented toward the base 4 on the first side panel 6. A second large flap 22 is formed in one of the second side panels 8. The second flap 22 extends from the opening rim 16 approximately over half the height of the second side panel 8. The second flap 22 is hinged to an edge oriented toward the base 4 on the second side panel 8.

In the first embodiment, a sensor 24 is formed in the first side panel 6 which contains no first flap 20. The sensor 24 in the first embodiment is a position sensor or an orientation sensor, respectively. The sensor 24 is formed in a section of the first side panel 6 facing the base 4. Preferably, the sensor 24 is held in a sensor holder 26 (see FIG. 3) in the first side panel 6. In a double-paneled design of the first side panel 6, the sensor holder is preferably formed between cover surfaces of the first side panel 6.

Figure 2:
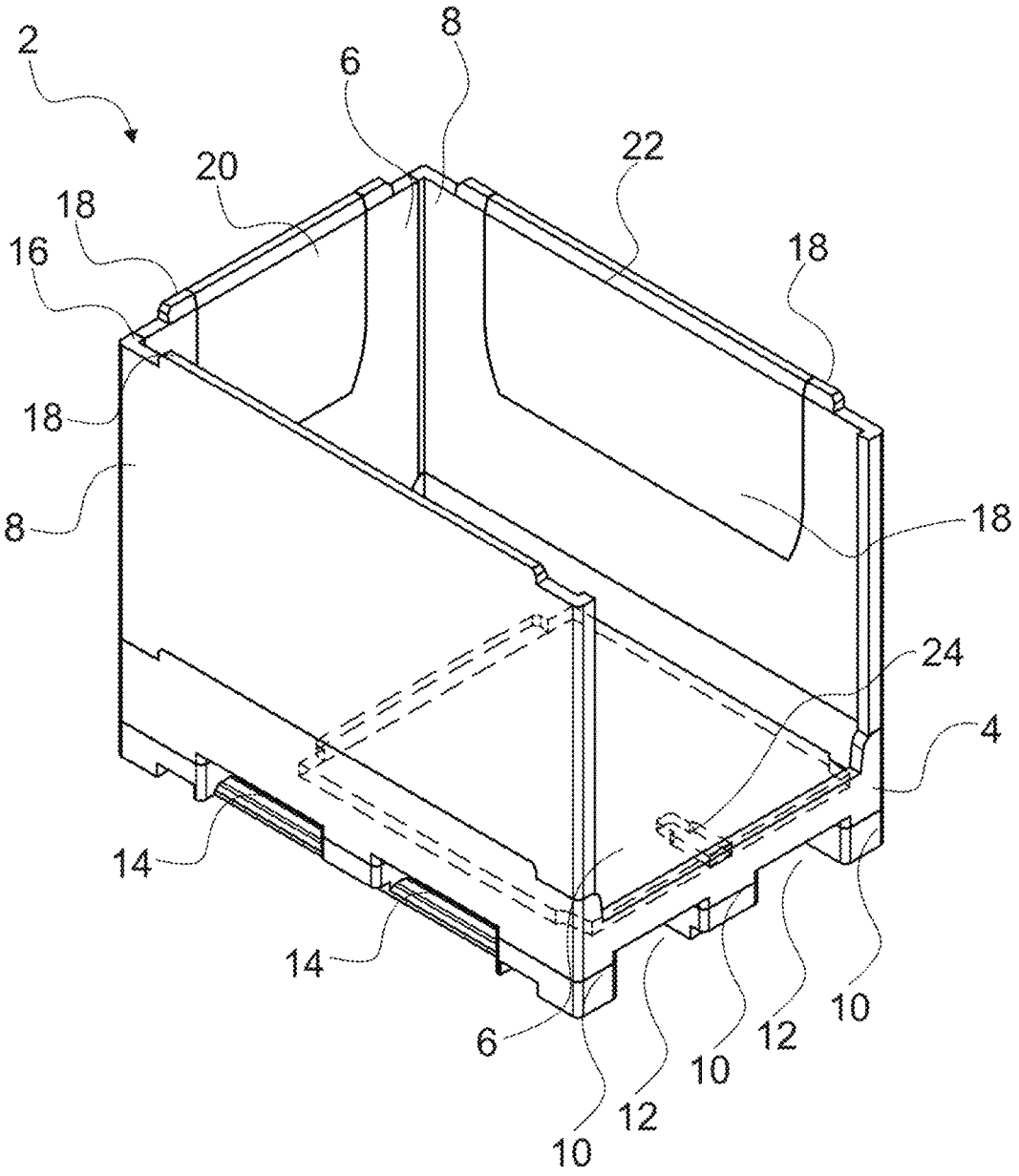
FIG. 2 is a perspective view of the first embodiment of a reusable transport container according to the invention having the side panels, wherein one of the side panels is in a non-upright position.

FIG. 2 illustrates the reusable transport container 2 according to the invention of the first embodiment, wherein the first side panel 6 including the sensor 24 is in a non-upright position. In other words, the first side panel 6 is folded. In said non-upright position, the first side panel 6 is oriented substantially in parallel to the base 4.

In a transport configuration of the reusable transport container 2, both of the first side panels 6 and both of the second side panels 8 are aligned/oriented substantially in parallel to the base 4. In the illustrated first embodiment, the second side panels 8 are hinged at a larger distance from the base 4 than the first side panels 6. In this way, the second side panels 8 can be folded onto the first side panels 6, and both the first side panels 6 and the second side panels 8 are aligned substantially in parallel to the base 4 in the non-upright position or in the transport configuration, respectively.

Figure 3:
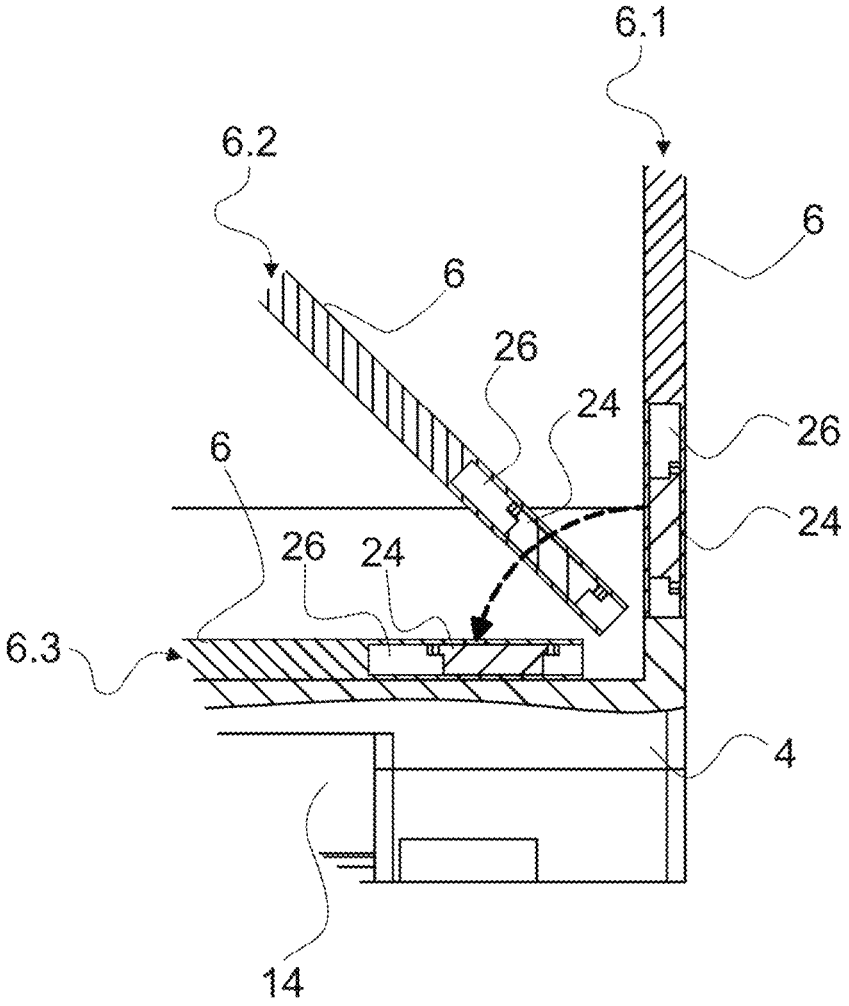
FIG. 3 is an enlarged schematic representation of a folding operation of the side panel section which includes a sensor.

FIG. 3 illustrates a schematic representation of a folding operation of the first side panel 6. For the purpose of illustration, the first side panel 6 is shown in three different positions. Accordingly, the first side panel 6 is shown in the (completely) upright position 6.1, the first side panel 6 is shown during the folding operation 6.2, and the first side panel 6 is shown in the non-upright position 6.3. The first side panel 6 in the (completely) upright position 6.1 is aligned substantially normal to the base 4. During the folding operation, then the first side panel 6 is folded around the joint axis using a joint (not shown) that connects the base 4 and the first side panel 6. In the non-upright position 6.3, the first side panel 6 is oriented substantially in parallel to the base and rests on the base 4. The first side panel 6 during the folding operation 6.2 is a position between the two end values of upright position 6.1 and non-upright position 6.3.

The first side panel 6 includes the sensor holder 26 which is provided and designed to hold the sensor 24. The sensor 24 is preferably completely enclosed by the sensor holder 26. The sensor holder 26 in the here shown first embodiment with the double-paneled side panel section and, resp., the double-paneled first side panels 6 and second side panels 8 is a cavity in the first side panel 6. Accordingly, the sensor holder 26 is tailored to dimensions of the sensor 24.

The sensor 24 is fixed in the sensor holder 26 so that the sensor 24 is efficiently prevented from moving relative to the first side panel 6 including the sensor 24. In other words, a sensor orientation at any point in time at which the sensor 24 is located in the sensor holder 26 of the first side panel 6 corresponds to a side panel orientation of the first side panel. Hence, when the first side panel 6 is in the upright position 6.1, also the sensor 24 is in the upright position 6.1.

This can be detected by the sensor 24 and can be communicated using a transmitting device. Preferably, the transmitting device is a wireless communication module permanently installed in the sensor 24. Therefore, if the sensor 24 detects that the sensor 24 and, thus, the first side panel 6 are in the upright position 6.1, said position can be communicated using the transmitting device.

If the upright position 6.1 is communicated, it can be concluded therefrom that the reusable transport container 2 is in use and/or is filled. In other words, it can be concluded therefrom that the reusable transport container 2 is not in storage or in a storing state and, thus, is not available.

If the first side panel 6 is in the non-upright position 6.3, the sensor 24 also is in the non-upright position 6.3. This can be detected by the sensor 24 and can be communicated by means of the transmitting device. Therefore, if the sensor 24 detects that the sensor 24 and, thus, the first side panel are in the non-upright position 6.3, said position can be communicated by means of the transmitting device. If the non-upright position 6.3 is communicated, one can conclude therefrom that the reusable transport container 2 is in storage or, resp., in the storing state. In other words, one can conclude therefrom that the reusable transport container 2 is not in use and thus is available.

Figure 4:
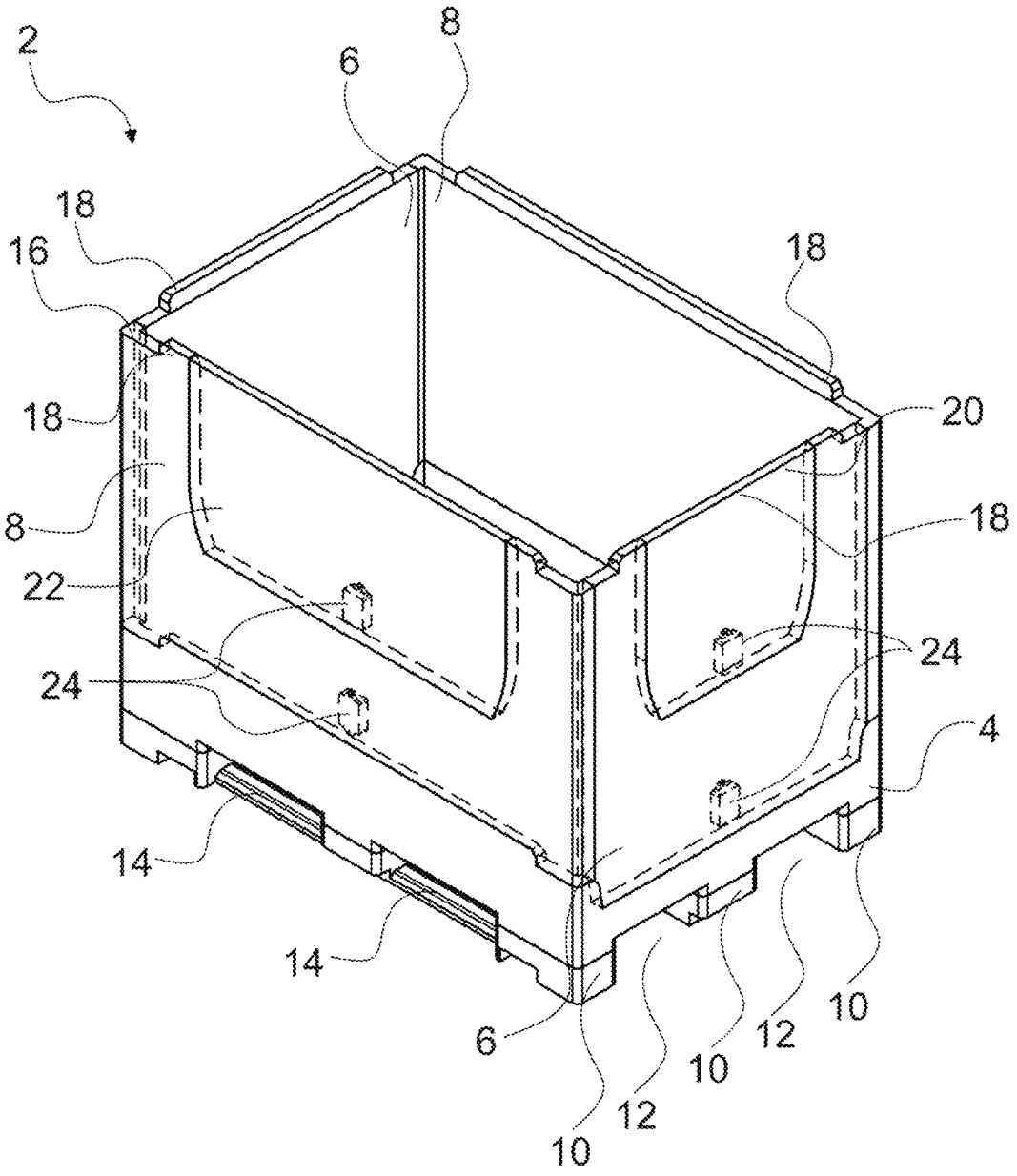
FIG. 4 is a perspective view of a second embodiment of the reusable transport container according to the invention.

The reusable transport container 2 shown in FIG. 4 includes, apart from the sensor 24 in the first side panel 6, also a sensor 24 in the second side panel 8. Further, the reusable transport container shown in FIG. 4 includes sensors 24 in the first flap 20 and in the second flap 22.

Each of the sensors 24 preferably communicates, apart from its current position, also its installation position and, resp., an individual identifier which can be associated with the installation position. In this way, it cannot only be detected whether the reusable transport container 2 is in use or in the storing state, but it can be concluded from the position of the first flap 20 and the second flap 22 whether the reusable transport container 2 is currently loaded or unloaded, or whether the reusable transport container 2 is filled in a resting situation. Thus, one can conclude from the transmitted position of the first flap 20 and the second flap 22 in which state of use the reusable transport container 2 is when the first side panels 6 and, resp., second side panels 8 are in the upright position.

A redundancy can be achieved by providing the sensor 24 both in the first side panel 6 and in the second side panel 8, allowing the determination of the state of the reusable transport container 2 to be rendered more reliable and less error-prone. In addition, it can also be detected by means of plural sensors 24 whether a reusable transport container 2 is defective. In this way, if there are plural sensors 24 which communicate positions different from each other both in first side panels 6 and in second side panels 8 of a defined reusable transport container 2, one can conclude therefrom that one of the side panels 6, 8 may have collapsed and cargo stored in the reusable transport container 2 may come out.

In the following, the reusable transport container 2 comprising an adapter 36 will be described based on FIG. 5 to FIG. 10. The repeated description of elements corresponding to those of the general embodiment (FIG. 1 to FIG. 4) is renounced. Hereinafter, in particular differences from the general embodiment will be discussed. The fastening of the sensor 24 to the first side panel 6 will be described by way of example. However, the sensor 24 can be fastened to any side panel section of the reusable transport container 2.

Figure 5:
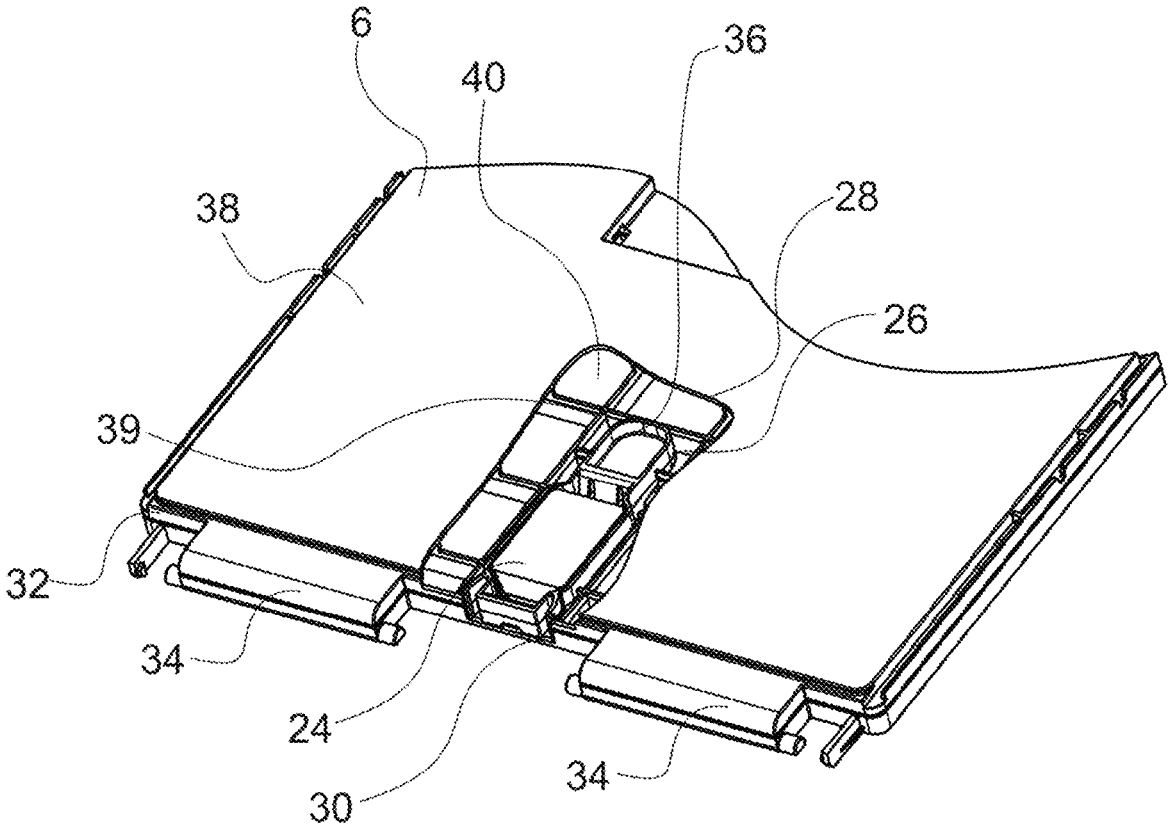
FIG. 5 is a first representation of a second embodiment comprising an adapter which is provided and designed to fix the sensor in the side panel section.

FIG. 5 illustrates a first side panel 6 in a second embodiment. The first side panel 6 in FIG. 5 is shown with a (graphical) breakout 28 for better illustration in an area of the sensor holder 26. A sensor holder opening 30 is formed in a hinge edge 32 of the first side panel. Hinge elements 34 which allow the first side panel 6 to be folded relative to the base 4 are formed at the hinge edge 32. The sensor holder 26 of the second embodiment is provided and designed to hold an adapter 36 specifically positively.

The adapter 36 is provided and designed to receive the sensor 24. The adapter 36 is shown in detail in FIGS. 8 to 10 and will be described in greater detail below. When inserted, the adapter 36 is substantially flush with the hinge edge 32. Further, from FIG. 5 an internal structure of the first side panel 6 is visible in the breakout 28. The first side panel 6 includes a first cover layer 38, a second cover layer 40 and a support structure 39, the support structure connecting the first cover layer 38 and the second cover layer 40 to each other.

Figure 6:
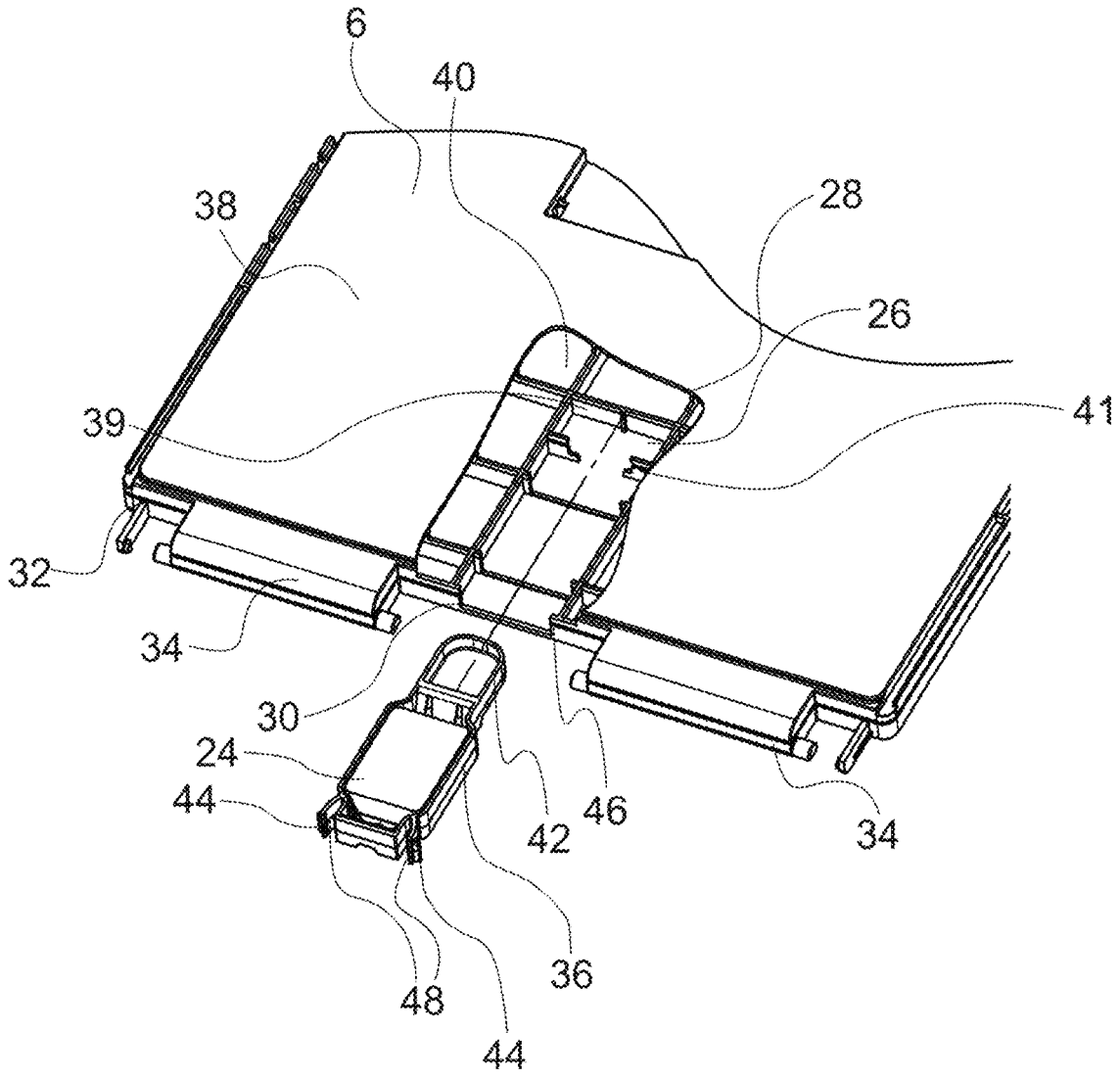
FIG. 6 is a second representation of a second embodiment illustrating an inserting operation of the adapter into the side panel section.

FIG. 6 illustrates an inserting operation of the adapter 36 into the sensor holder 26. The adapter 36 in which the sensor 24 is received specifically positively is inserted into the sensor holder 26 via the sensor holder opening 30 located in the hinge edge 32. In the sensor holder 26 at least one positioning bar 41 is formed which interacts with a positioning aid 42 formed on the adapter 36 in such a way that the adapter 36 can be inserted into the sensor holder 26 in exactly a defined inserting orientation. Locking hooks 44 which are provided and formed to engage in a locking section 46 of the sensor holder 26 are formed on the side of the adapter 36 remote from the positioning aid 42.

Figure 7:
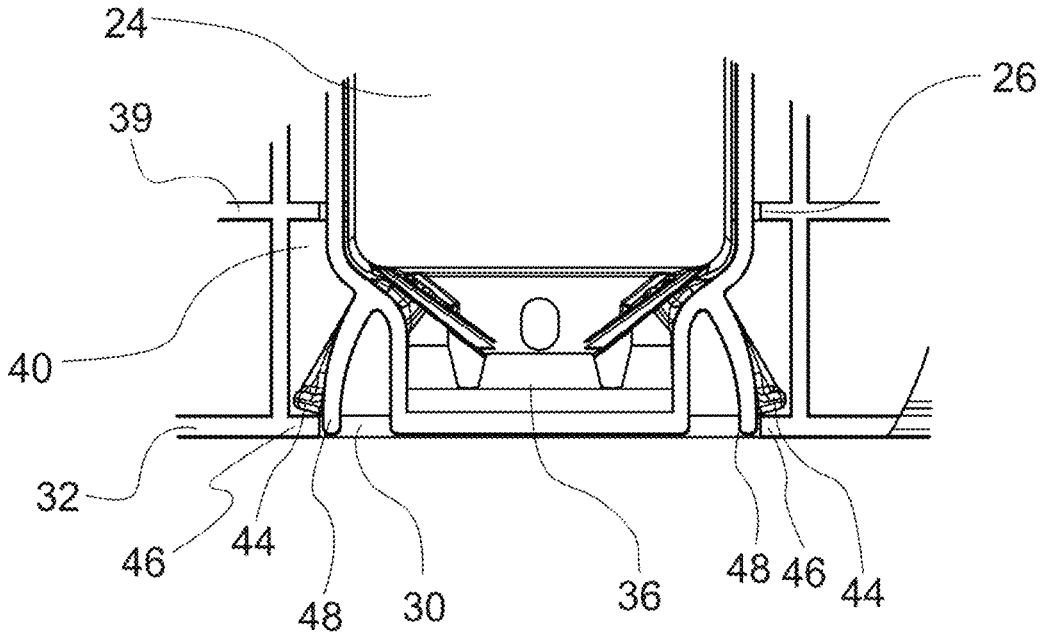
FIG. 7 is a representation of a locking mechanism of the adapter in a sensor holder of the side panel section of the second embodiment.

FIG. 7 illustrates an enlarged view of the locking hooks 44 of the adapter 36 in a state in which the locking hooks 44 are engaged in a locking section 46 of the sensor holder 26. The locking hooks 44 are connected to or, resp., materially formed with spring levers 48. The spring levers 48 press the locking hooks 44 behind the locking sections 46 of the sensor holder 26 so that the adapter 36 is positively fixed in the sensor holder 26. When an operating person compresses the spring levers 48, the locking hooks can be moved in the direction of the sensor holder opening 30 and the adapter 36 then can be removed from the sensor holder 26.

Figure 8:
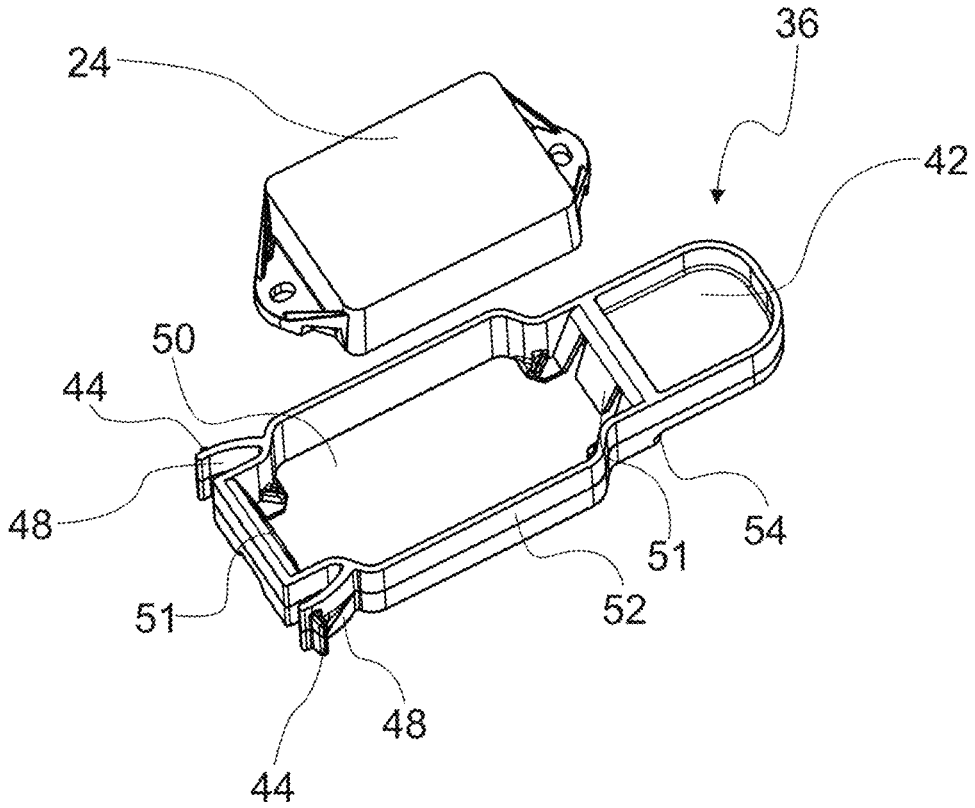
FIG. 8 is a representation of the adapter and the sensor in a state in which the sensor and the adapter are separated.
Figure 9:
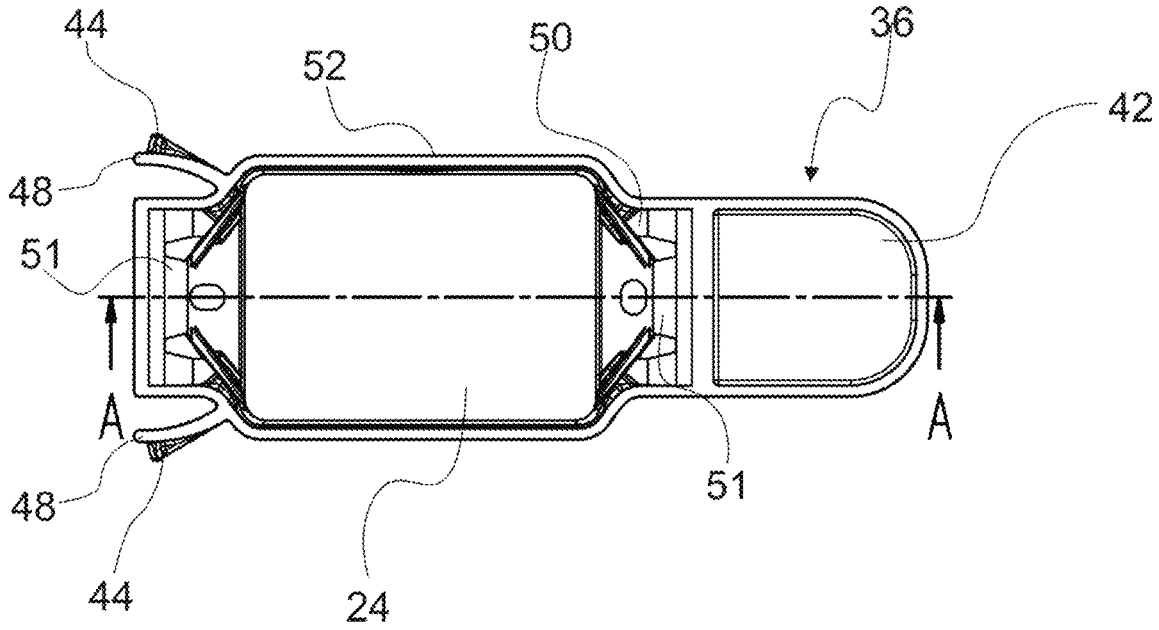
FIG. 9 is a representation of the adapter and the sensor in a state in which the sensor is inserted in the adapter.
Figure 10:
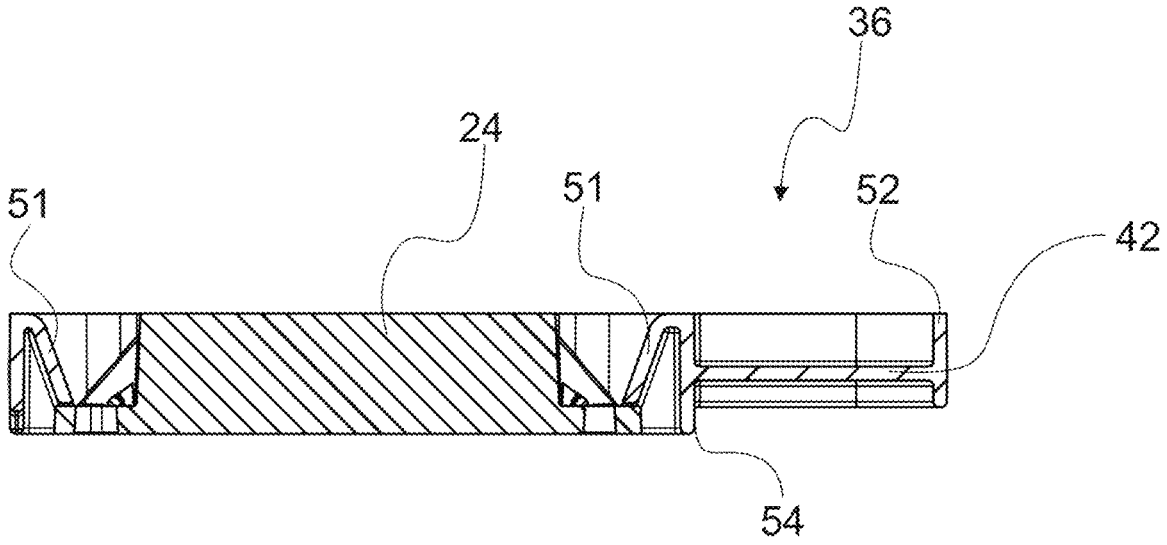
FIG. 10 is a section view of the adapter and the sensor along the line A-A in FIG. 9.

FIG. 8, FIG. 9 and FIG. 10 illustrate the adapter 36 and the sensor 24, FIG. 10 being a section view along the line A-A in FIG. 9. The adapter 36 includes an adapter base 50 and an adapter side panel 52 circumferentially extending substantially perpendicularly away from the adapter base 50. Further, the adapter 36 includes a sensor locking geometry 51 which positively fixes the sensor 24 in the adapter 36. On the adapter side panel, the two spring levers 48 with the locking hooks 44 are formed at a first end of the adapter 36, wherein a function of the spring levers 48 with the locking hooks 44 was explained already by way of FIG. 7.

The positioning aid 42 is formed at a second end of the adapter 36 which is opposite to the first end of the adapter 36 in a longitudinal direction of the adapter. In other words, the positioning aid 42 is formed on a side of the adapter remote from the locking hooks 44. In the area of the positioning aid 42, the adapter base 50 is upwardly offset. In other words, the adapter base 50 has a step 54 toward an extension direction of the adapter side panels 52 in the area of the positioning aid 42. Furthermore, the adapter side panel 52 is designed to be retracted in the area of the positioning aid 42. In other words, a distance between opposite sections of the adapter side panels 52 is reduced in the area of the positioning aid 42.

Hereinafter, the reusable transport container 2 comprising a mount geometry 56 provided and designed to receive the sensor 24 in exactly a specific orientation will be described based on FIG. 11 to FIG. 19. The repeated description of elements corresponding to those of the general embodiment is renounced. In the following, in particular differences from the general embodiment will be discussed. The fastening of the sensor 24 to the first side panel 6 is described by way of example. However, the sensor 24 can be fastened on any side panel section of the reusable transport container 2.

Figure 11:
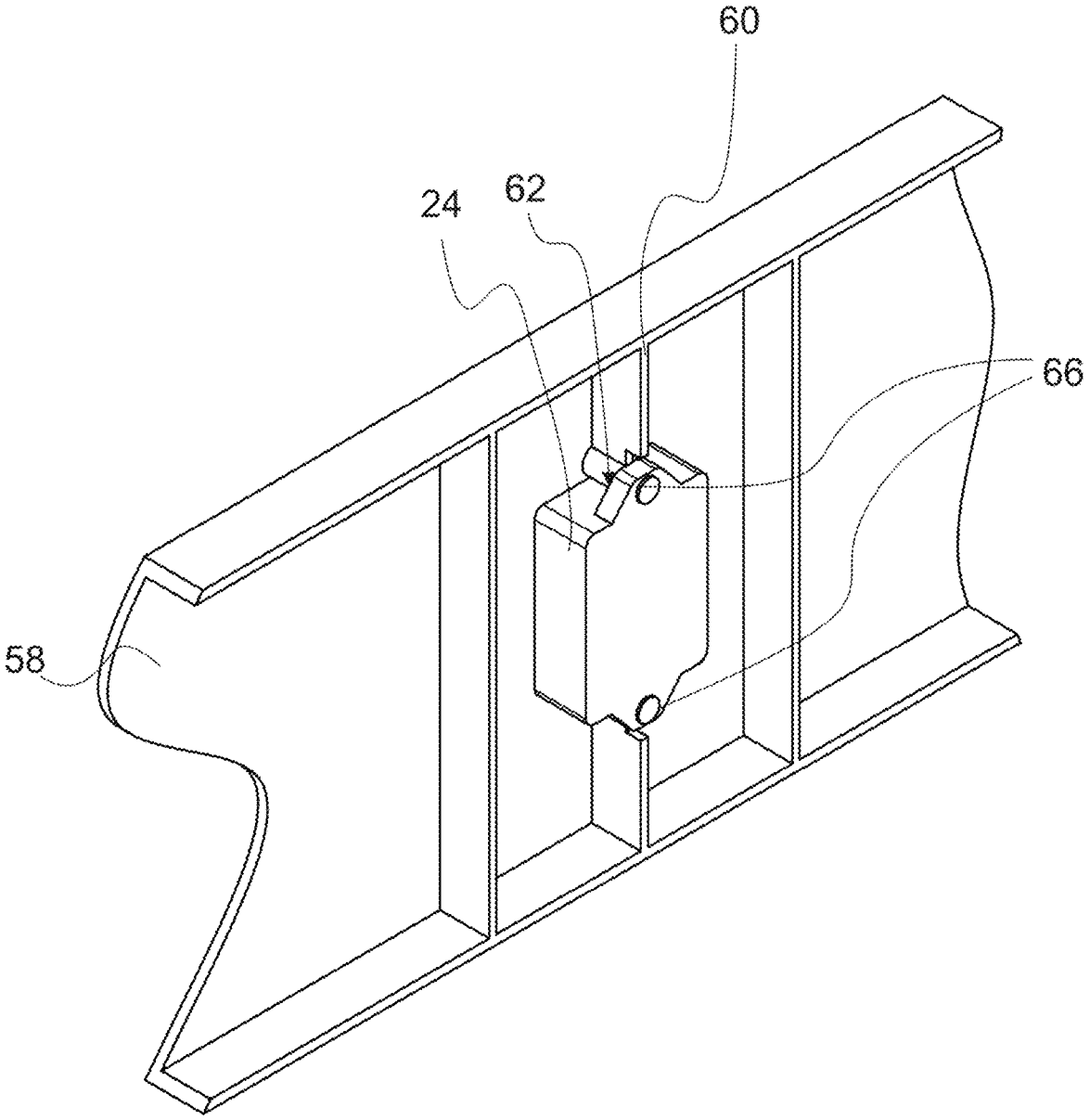
FIG. 11 is a first representation of a third embodiment in a first variant, the sensor being mounted on the side panel section.
Figure 12:
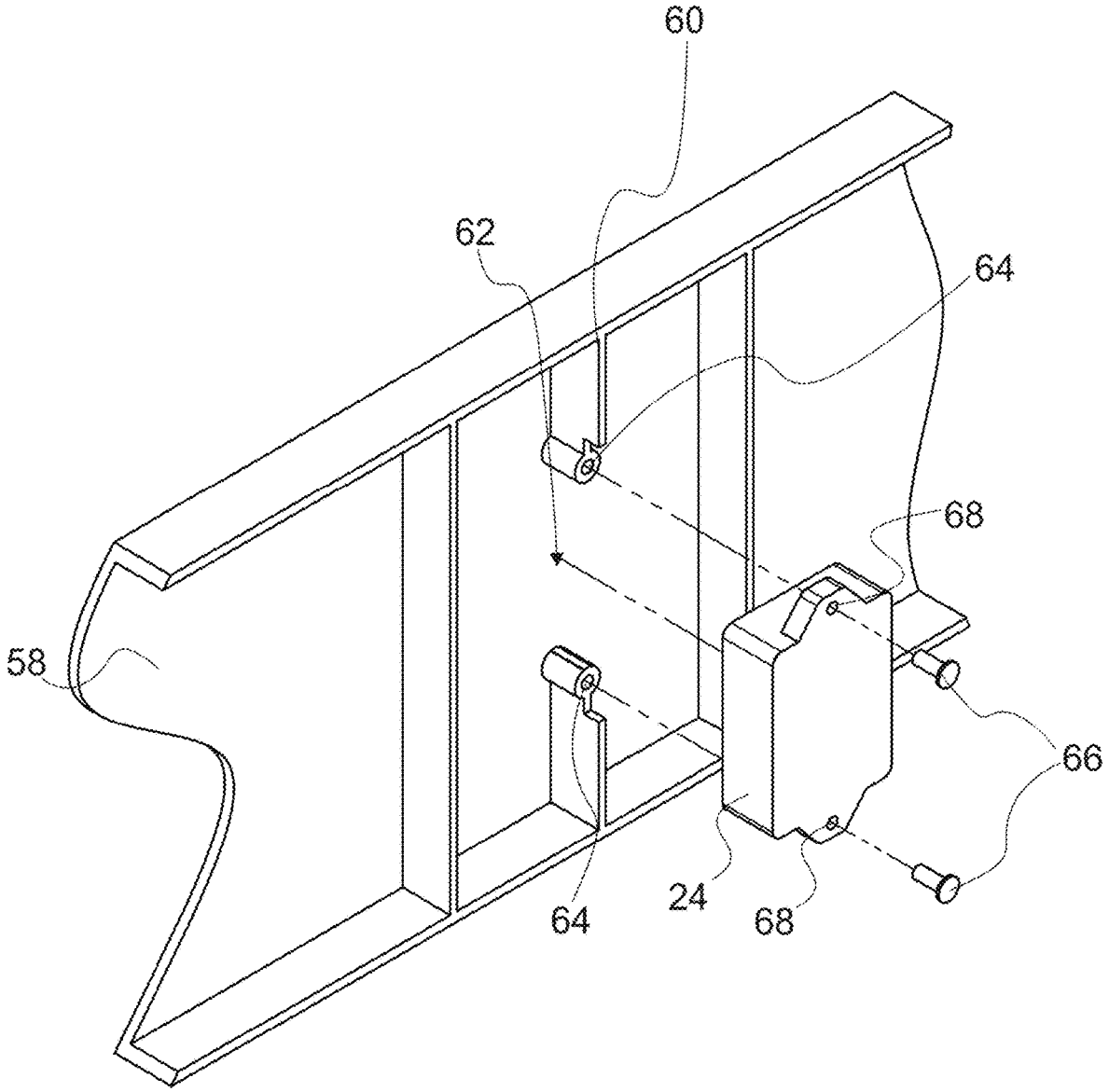
FIG. 12 is a second representation of the third embodiment in the first variant, the sensor not being mounted on the side panel section (dismounted state)

FIG. 11 and FIG. 12 show the first side panel 6 in a third embodiment in a first variant, FIG. 11 showing the sensor 24 in a state mounted to the first side panel 6, and FIG. 12 showing the sensor in a state dismounted from the first side panel 6. The first side panel 6 includes a panel surface 58 and stiffening elements 60. The panel surface 58 and the stiffening elements 60 are preferably formed integrally. In a first variant, the stiffening elements 60 include a holding geometry 62 provided and designed to hold the sensor 24. Of preference, the sensor 24 is flush with the panel surface 58. The holding geometry 62 of the first variant particularly includes two threaded holes 64 which are formed in the stiffening elements 62. The sensor 24 is fixed in the holding geometry 62 by means of screws 66 which are screwed into the threaded holes 64. Concretely, the screws 66 are screwed through sensor through-holes 68 of the sensor 24 in the threaded holes 64. A distance of the threaded holes 64 corresponds to a distance of the sensor through-holes 68.

Figure 13:
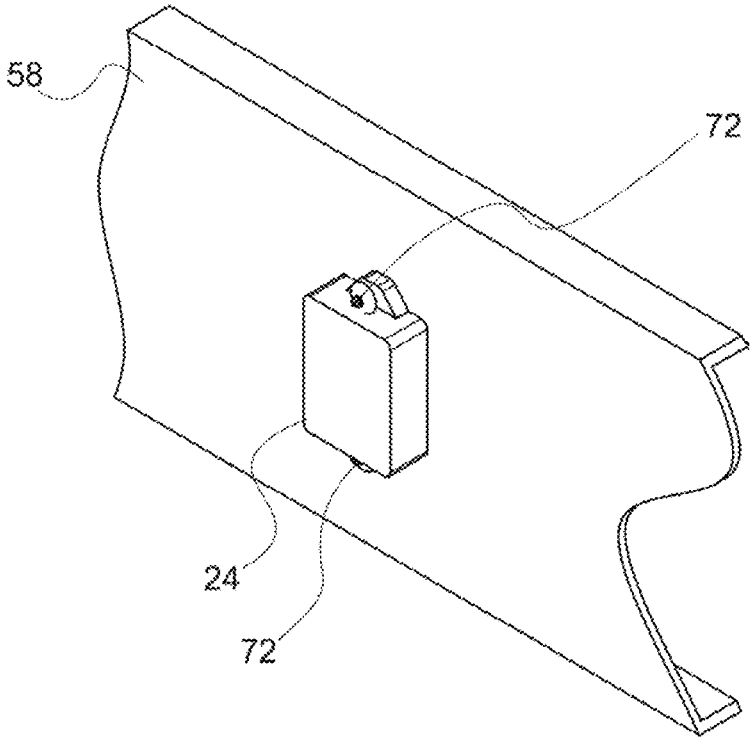
FIG. 13 is a first representation of the third embodiment in a second variant.
Figure 14:
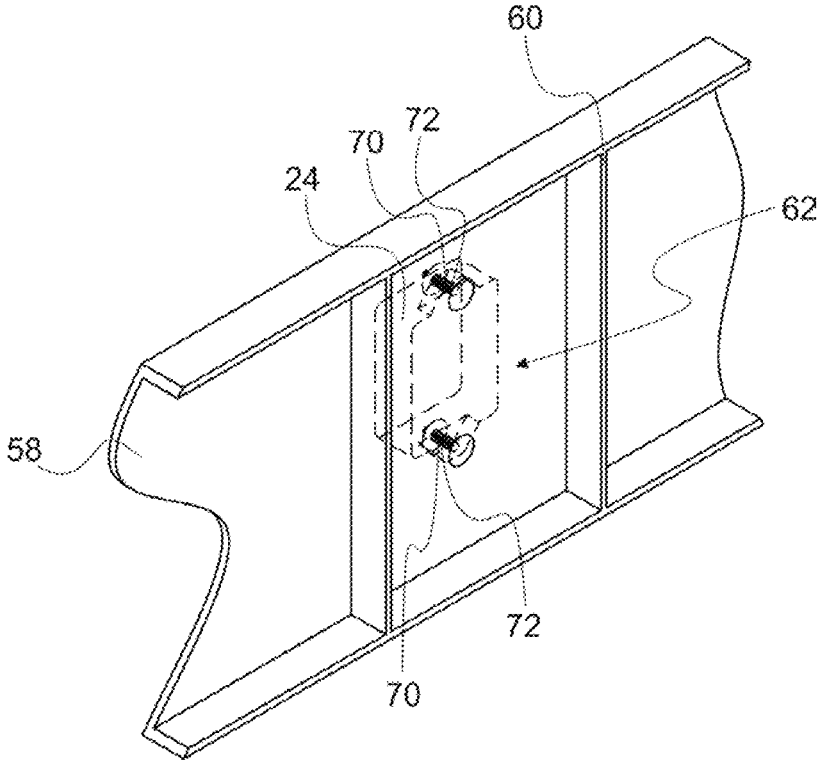
FIG. 14 is a second representation of the third embodiment in the second variant.

FIG. 13 and FIG. 14 illustrate the first side panel 6 in the third embodiment in a second variant, FIG. 13 being a view that shows the sensor 24 fixed to a side of the panel surface 58 remote from the stiffening elements 60, and FIG. 14 showing the holding geometry 62 from a side of the panel surface 58 facing the stiffening elements 60. The holding geometry 62 of the second variant includes substantially two side panel through-holes 70. A distance of the side panel through-holes 70 corresponds to the distance of the sensor through-holes 68. The sensor 24 is fixed to the side panel section by means of fasteners in the form of locking rivets 72 which are passed through each of the side panel through-hole 70 and the sensor through-hole 72. Alternative fasteners are a screw and nut connection, conventional riveting or the like.

Figure 15:
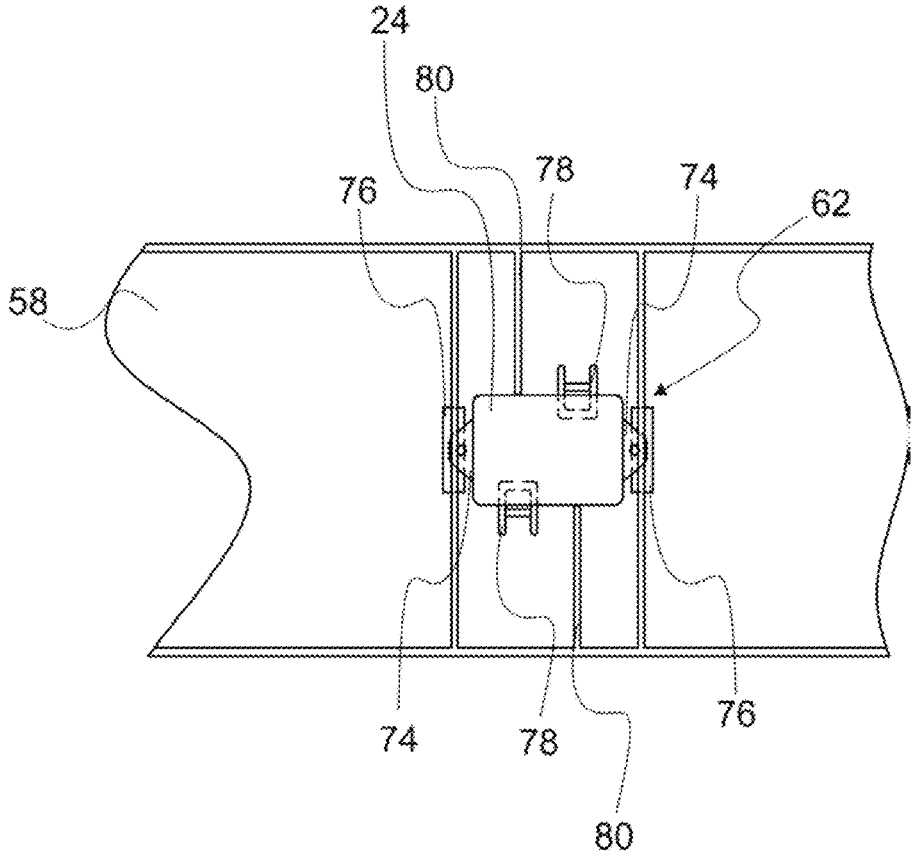
FIG. 15 is a first representation of the third embodiment in a third variant.
Figure 16:
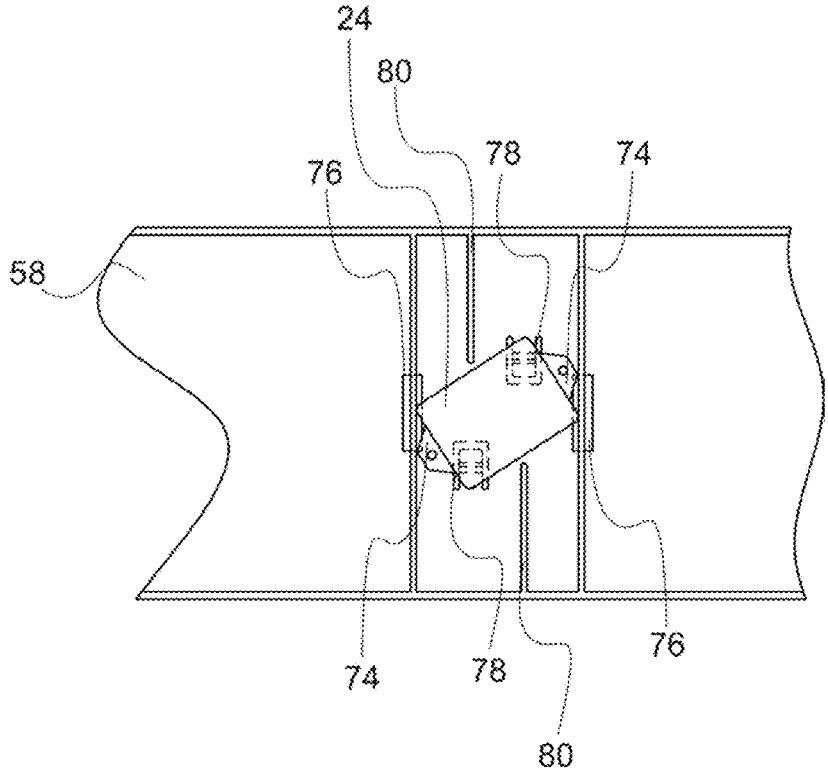
FIG. 16 is a second representation of the third embodiment in the third variant, the sensor not being mounted on the side panel section (dismounted state)
Figure 17:
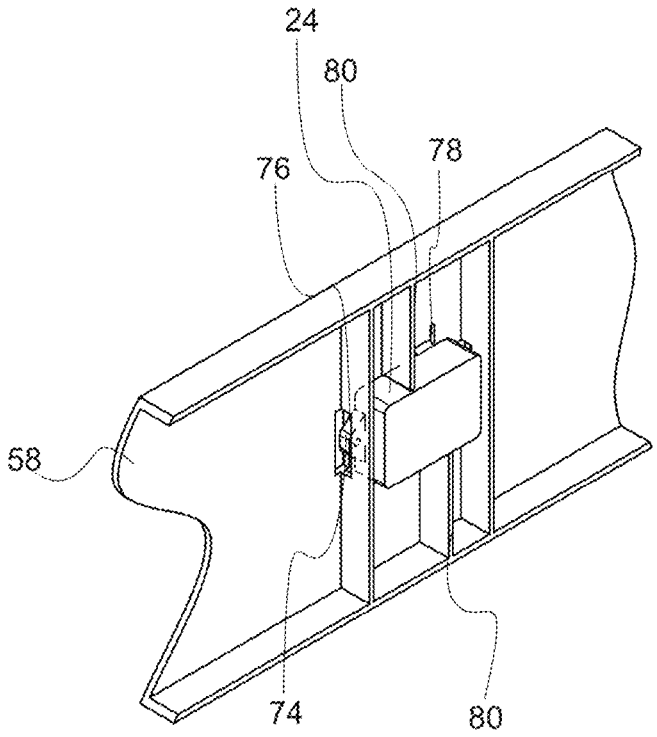
FIG. 17 is a third representation of the third embodiment in the third variant.

FIG. 15, FIG. 16 and FIG. 17 illustrate the first side panel 6 in the third embodiment in a third variant, FIG. 15 showing a locked state of the sensor 24 in the holding geometry 62, and FIG. 16 showing an unlocked state of the sensor 24 in the holding geometry 62. FIG. 17 is a perspective view of the locked state. The sensor 24 includes fastening surfaces 74 which in the locked state in FIG. 15 and FIG. 17 are positioned behind retaining sections 76. The retaining sections 76 prevent the sensor from moving normal to the first side panel 6. Side panel section locking hooks 78 are formed on the first side panel 6. The side panel section locking hooks 78 are preferably resilient locking elements which prevent, together with stiffening support struts 80, the sensor 24 from moving in parallel to the first side panel 6. During an inserting operation, the sensor 24 is inserted, as shown in FIG. 16, in a defined inserting position. In the inserting position, the sensor presses the side panel section locking hooks 78 toward the side panel section 6. Subsequently, by rotating the sensor 6, the fastening surfaces 74 are moved behind the retaining sections 76. In the locked position, the side panel section locking hooks 78 are moved back to their home position by spring force and thus fix the sensor 24. In the locked position, the stiffening support struts additionally contact the sensor 24.

Figure 18:
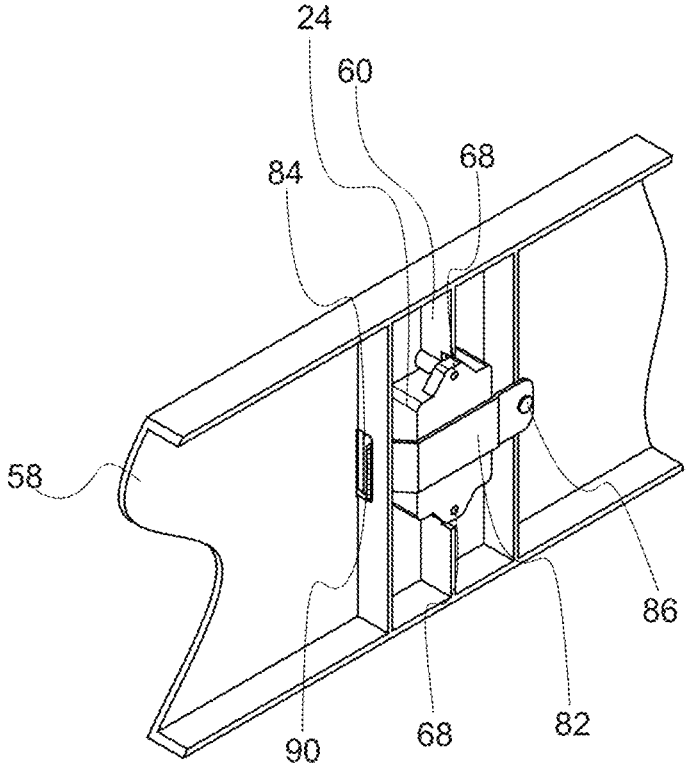
FIG. 18 is a first representation of the third embodiment in a fourth variant.
Figure 19:
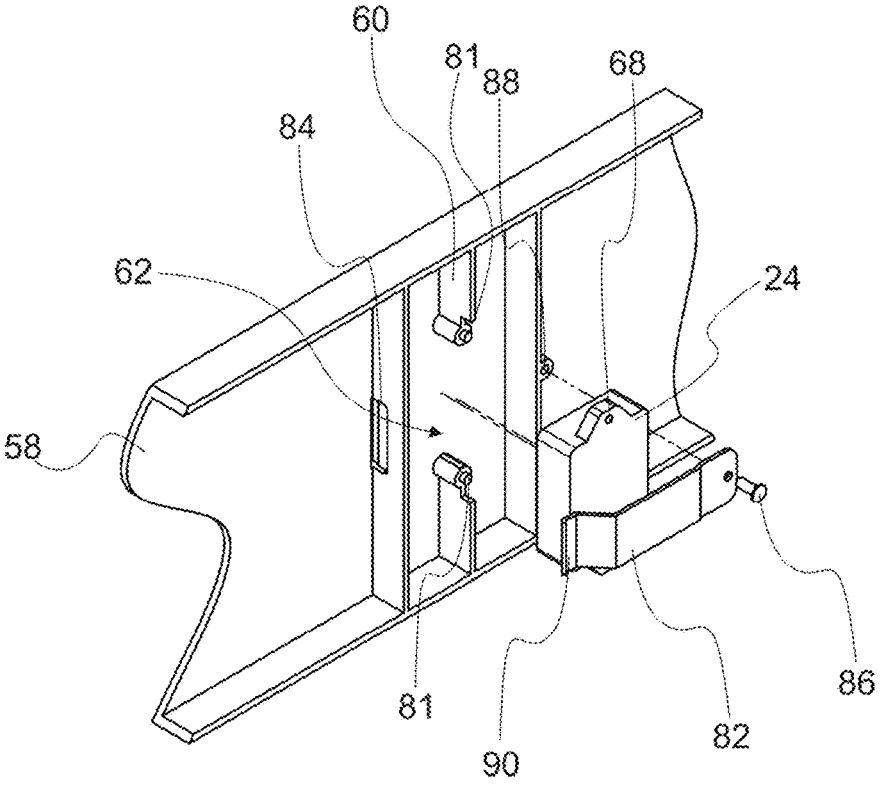
FIG. 19 is a second representation of the third embodiment in the fourth variant, the sensor not being mounted on the side panel section (dismounted state)

FIG. 18 and FIG. 19 illustrate the first side panel 6 in the third embodiment in a fourth variant, FIG. 18 representing a mounted state and FIG. 19 representing a non-mounted state. The holding geometry 62 formed on the side panel 6 in the fourth variant includes two pin-shaped holders 81 which are provided and designed to engage in the sensor through-holes 68 of the sensor 24. Further, the holding geometry 62 in the fourth variant includes a fixing bracket 82 which is provided and designed to engage in a fixing bracket breakout 84 of the first side panel 6 and to be screwed by means of a fixing bracket screw 86 which is screwed into a fixing bracket threaded hole 88. In a mounted state, the pin-shaped holders 81 are positioned in the sensor through-holes 68 of the sensor 24. The sensor 24 is flush with the first side panel 6 and, resp., is oriented substantially in parallel to the first side panel 6. The fixing bracket 82 is arranged with a fixing bracket engaging edge 90 in the fixing bracket breakout 84 of the first side panel 6 and is screwed by the fixing bracket screw 86 which is screwed into the fixing bracket threaded hole 88 in the direction of the first side panel 6. Accordingly, the fixing bracket 82 encompasses the sensor 24 and fixes the sensor 24 in a direction normal to the first side panel 6. The sensor is tightly connected to the first side panel 6 by the fixing bracket 82 and the pin-shaped holders 81 in the sensor through-holes 68.

In the following, based on FIG. 20, FIG. 21 and FIG. 22, the reusable transport container 2 comprising a sensor holder 26 which is closed by a lid 92 is described, the lid 92 when mounted being flush with the side panel section, which reusable transport container 2 may also be described independently. The repeated description of elements corresponding to those of the general embodiment is renounced. Hereinafter, in particular differences from the general embodiment shall be discussed. The fastening of the sensor 24 to the first side panel 6 is described by way of example. However, the sensor 24 can be fastened to any side panel section of the reusable transport container 2.

Figure 20:
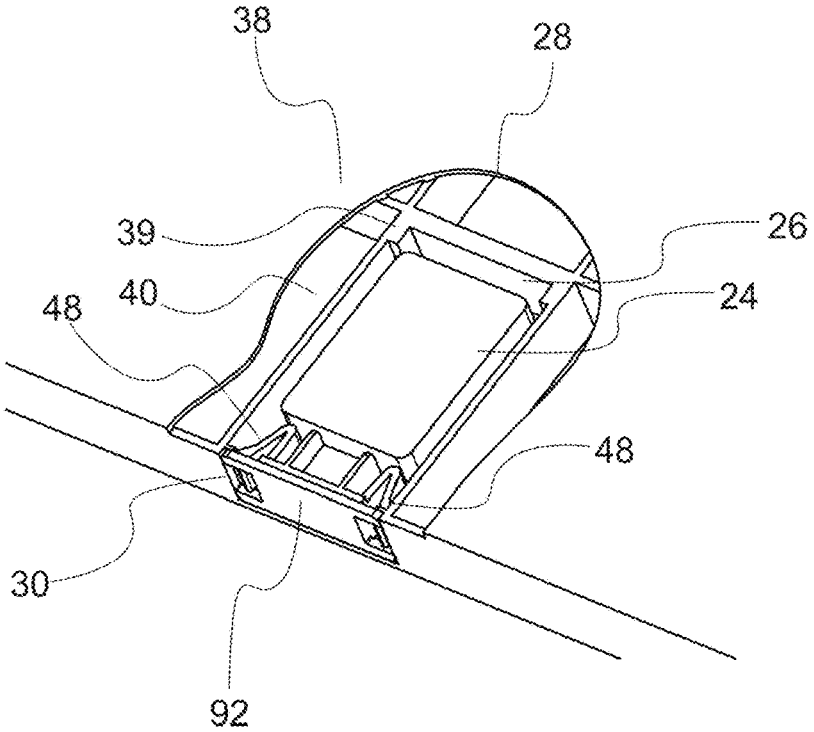
FIG. 20 is a first representation of a fourth embodiment.
Figure 21:
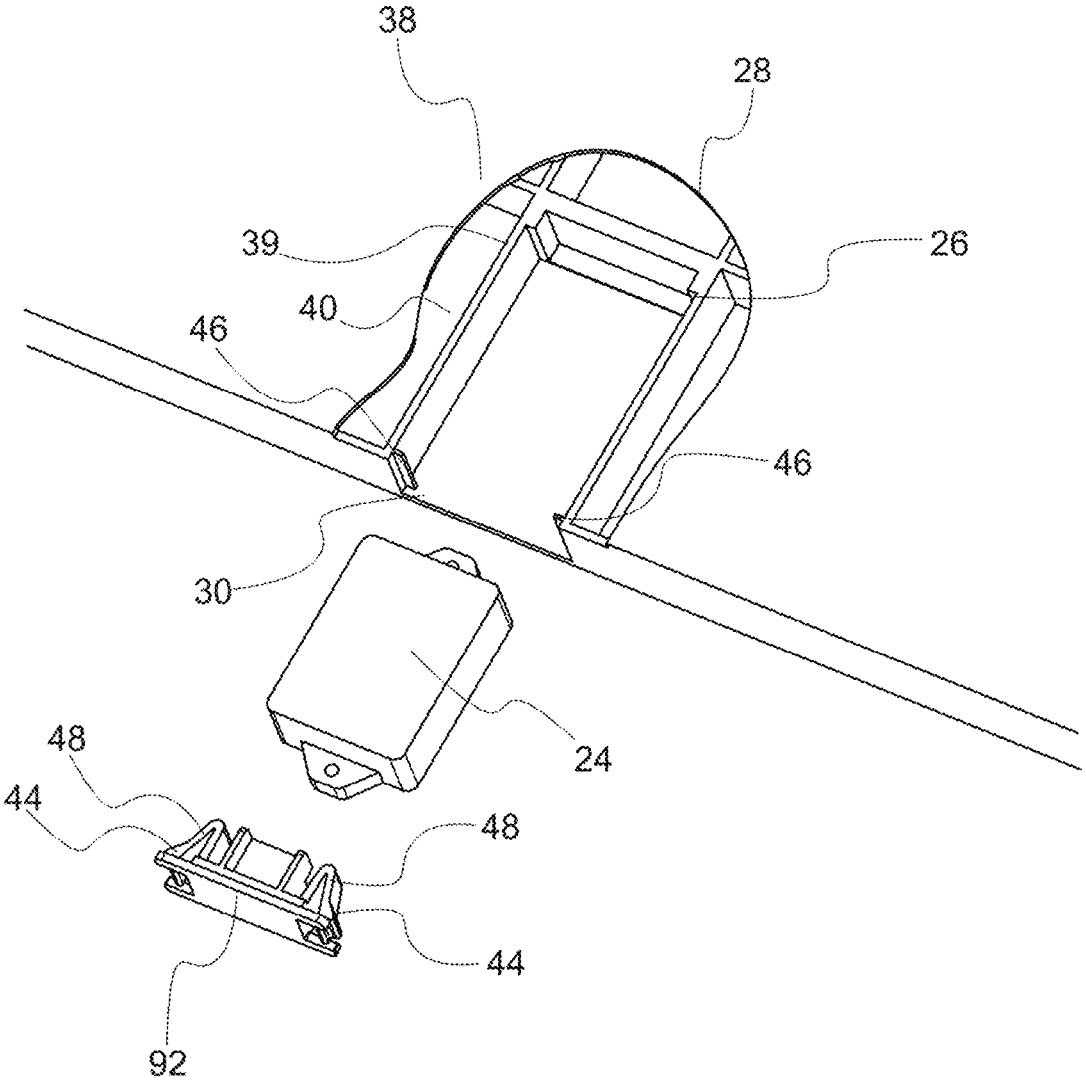
FIG. 21 is a second representation of the fourth embodiment, the sensor not being mounted on the side panel section (dismounted state)
Figure 22:
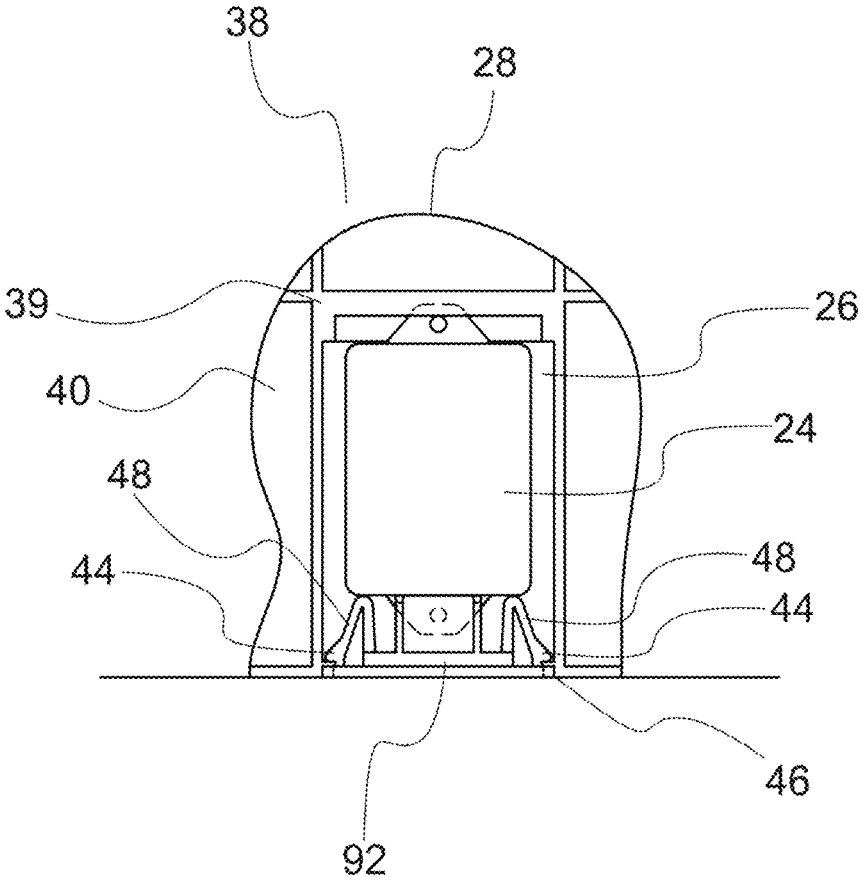
FIG. 22 is a third representation of the fourth embodiment.

In detail, the FIGS. 20 to 22 illustrate a cutout of the first side panel 6 in a fourth embodiment. The first side panel 6 in FIGS. 20 to 22 is shown with a (graphical) outbreak 28 for better illustration in an area of the sensor holder 26. From FIGS. 20 to 22, an internal structure of the first side panel 6 is visible in the outbreak 28. The first side panel 6 includes the first cover layer 38, the second cover layer 40 and the support structure 39, the support structure connecting the first cover layer 38 and the second cover layer 40 to each other. The sensor holder 26 is formed inside the support structure 39. In other words, the sensor holder 26 is formed between the first cover layer 38 and the second cover layer 40. The sensor holder 26 is configured to hold the sensor 24 in particular completely. The sensor holder 26 includes the sensor holder opening 30. An internal geometry of the sensor holder 26 can be tailored to dimensions of the sensor 24.

The sensor holder 26 of the fourth embodiment is closed by the lid 92. In particular, the lid 92 closes the sensor holder opening 30. FIG. 20 and FIG. 22 illustrate a view with locking hooks 44 on the cover 92 in a state in which the locking hooks 44 are locked in a locking section 46 of the sensor holder 26. The locking hooks 44 are connected to and/or formed materially with spring levers 48. The spring levers 48 press the locking hooks 44 behind the locking sections 46 of the sensor holder 26 so that the lid 92 is positively fixed in the sensor holder 26. When an operating person compresses the spring levers 48, the locking hooks can be moved toward the sensor holder opening 30 and the adapter 36 can then be removed from the sensor holder 26. In a closed state, the lid 92 is flush with the side panel 6.

In a preferred development of the fourth embodiment, the lid 92 and, resp., the geometry of the lid 92 can be adjusted to the dimensions of the sensor 24 so that the sensor 24 is positively fixed in the sensor holder 26 substantially without play.

The fourth embodiment described here has the lid 92 at an edge of the first side panel 6. The lid 92 can be formed explicitly also in the first cover layer 38 and/or in the second cover layer 40.

A panel thickness of the lid 92 may be smaller than the panel thickness of the first cover layer 38 and the panel thickness of the second cover layer 40.

Figure 23:
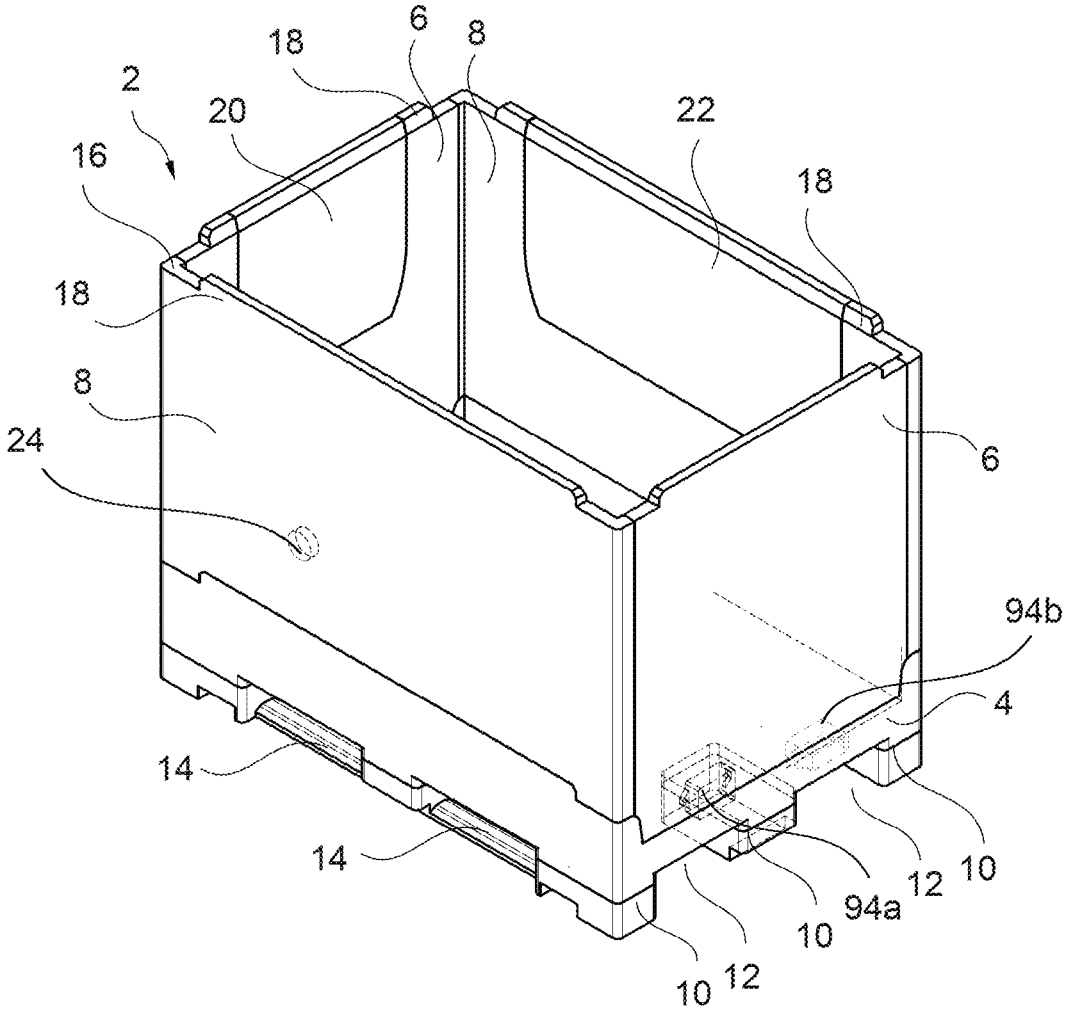
FIG. 23 is a perspective representation of the reusable transport container according to the invention of a fifth embodiment having side panels shown to be partly transparent.
Figure 24:
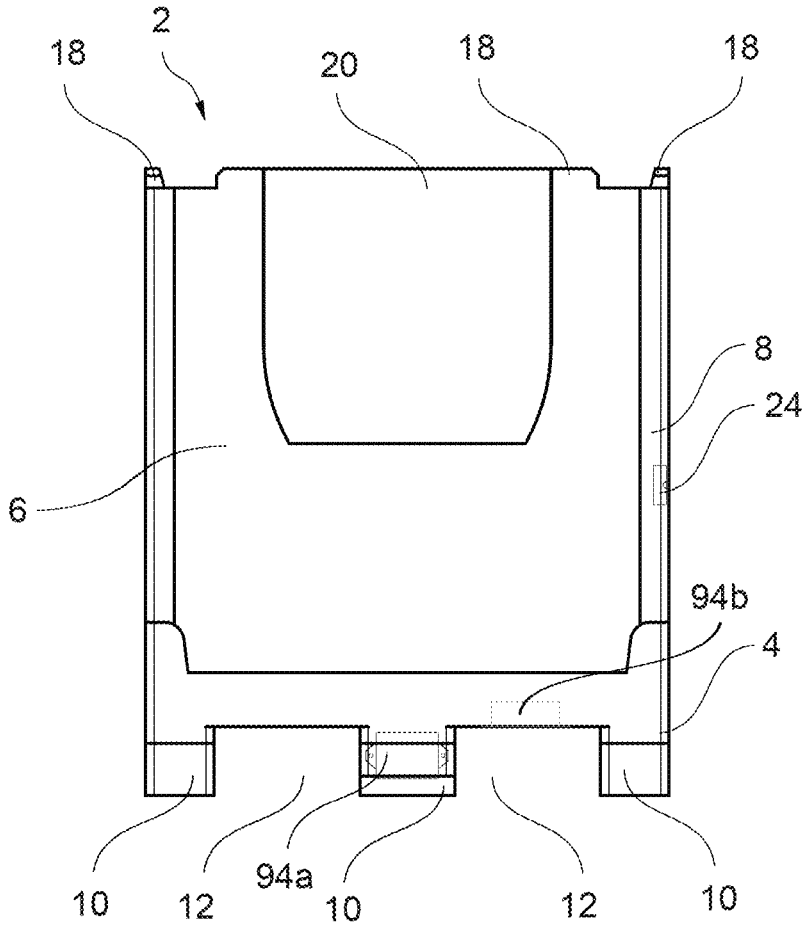
FIG. 24 is a front view of the fifth embodiment.

FIG. 23 and FIG. 24 illustrate a fifth embodiment in two alternatives. Hereinafter, only differences from the first embodiment shall be discussed.

In the reusable transport container 2 of the fifth embodiment, the (position/orientation) sensor 24 and the communication module 94*a*; 94*b* are designed separately from each other.

In the first alternative of the fifth embodiment, the communication module 94*a* is designed in the central stand skid 10 of the reusable transport container 2 and communicates wirelessly with the sensor 24 formed in the side panel 8. The communication module 94*a* is arranged, in a longitudinal direction of the central stand skid 10, spaced apart from the side panel 6 to protect the communication module 94*a* against lateral impacts.

In the second alternative of the fifth embodiment, the communication module 94*b* is formed in the base 4 of the reusable transport container. In the embodiment shown here, the communication module 94*b* is formed in an area between two stand skids 10 in the base 4.

As a matter of course, the communication module 94*a*, 94*b* may be configured at any other suitable position in or on the base 4. In this way, the communication module 94*a*, 94*b* may be formed in one of the stand skids in an embodiment in which the base 4 is designed with, specifically nine, independent stand skids.

Both the sensor 24 and the communication module 94*a*, 94*b* can be formed/fixed in/on the reusable transport container 2 in any described type of fastening. In the fifth embodiment, one sensor 24 is formed in the side panel 8. As a matter of course, more than one sensor 24 may be formed in different side panels 6, 8 of the reusable transport container.

In another embodiment (not shown), the sensor 24 including the communication module can be designed, according to any one of the first four embodiments, in a first one of the side panels 6, 8, and a sensor having no separate communication module can be designed in a second one of the side panels 6, 8.

The above-described embodiments are meant to be examples, and features which are described in combination with a particular embodiment here can be applied to a different embodiment.

Furthermore, a reusable transport container comprising first and second side panels rigidly connected to the base can be provided with a sensor only in the first flap and/or in the second flap.

In another embodiment (not shown), the sensor holder can be produced by mold blowing.

LIST OF REFERENCE NUMERALS

2 reusable transport container
4 base
6 first side panel
8 second side panel
10 stand skid
12 first fork opening
14 second fork opening
16 opening rim
18 locking edge
20 first flap
22 second flap
24 sensor
26 sensor holder
28 breakout
30 sensor holder opening
32 hinge edge
34 hinge element
36 adapter
38 first cover layer
39 support structure
40 second cover layer
41 positioning bar
42 positioning aid
44 locking hook
46 locking section
48 spring lever
50 adapter base
51 sensor locking geometry
52 adapter side panel
54 step
56 holding geometry
58 panel surface
60 stiffening element
62 holding geometry
64 threaded hole
66 screw
68 sensor through-hole
70 side panel through-hole
72 locking rivet
74 fastening surface
76 retaining section
78 side panel section locking hook
80 stiffening support struts
81 pin-shaped holder
82 fixing bracket

84 fixing bracket breakout
86 fixing bracket screw
88 fixing bracket threaded hole
90 fixing bracket engaging edge
92 lid
94*a* communication module
94*b* communication module
6.1 (completely) upright position
6.2 position during the folding operation
6.3 non-upright position

The invention claimed is:

1. A reusable transport container comprising:

a base and side panel sections arranged on the base, the side panel sections being foldable and/or collapsible, the side panel sections being movable to an upright position in which the side panel sections are substantially perpendicular to the base, and movable to a non-upright position in which the side panel sections are folded or collapsed;

at least one tilt sensor configured to distinguish between the upright position and the non-upright position of at least one of the side panel sections based on an orientation of the at least one tilt sensor and earth's gravitational field, such that the at least one tilt sensor is configured to independently determine whether the at least one of the side panel sections is in the upright position or in the non-upright position; and a transmitting device coupled to or integrated in the at least one tilt sensor, the transmitting device configured to output different signals corresponding to the orientation of the at least one tilt sensor.

2. The reusable transport container according to claim 1, wherein the at least one tilt sensor is formed in and/or on said at least one of the side panel sections.

3. The reusable transport container according to claim 2, wherein orientations of the at least one tilt sensor in the upright position of the at least one of the side panel sections and in the non-upright position of the at least one of the side panel sections are different by approximately 90°.

4. The reusable transport container according to claim 1, wherein the at least one tilt sensor is received completely and without a projection in the at least one of the side panel sections.

5. The reusable transport container according to claim 1, wherein the side panel sections are formed to be double-paneled as a double panel, wherein the at least one of the side panel sections has a sensor holder inside the double panel which is configured to hold the at least one tilt sensor.

6. The reusable transport container according to claim 5, wherein a sensor holder opening is formed on a hinge edge of the at least one of the side panel sections.

7. The reusable transport container according to claim 5, wherein a material thickness of the double panel is reduced in an area of the sensor holder.

8. The reusable transport container according to claim 5, wherein the at least one tilt sensor is fixed in the sensor holder by an adapter.

9. The reusable transport container according to claim 8, wherein the adapter is locked positively in the sensor holder of the at least one of the side panel sections.

10. The reusable transport container according to claim 8, wherein the adapter has a positioning aid by which the adapter is insertable into the sensor holder in exclusively one defined inserting orientation.

11. The reusable transport container according to claim 8, wherein the adapter has a sensor locking geometry in which the at least one tilt sensor is locked in the adapter.

12. The reusable transport container according to claim 1, wherein the at least one tilt sensor is fastened to the at least one of the side panel sections by at least one fastener.

13. The reusable transport container according to claim 12, wherein the at least one of the side panel sections has at least one holding geometry which is provided and designed to hold the at least one tilt sensor in exactly one specific orientation.

14. The reusable transport container according to claim 5, wherein the sensor holder is closed by a lid, the lid being flush with the at least one of the side panel sections when the lid is in a mounted state.

15. The reusable transport container according to claim 1, wherein the at least one tilt sensor is formed in the at least one of the side panel sections and the transmitting device is formed in the base.

16. The reusable transport container according to claim 15, wherein the transmitting device is formed in a stand or a stand skid of the base.

17. The reusable transport container according to claim 1, wherein the at least one tilt sensor is designed to wirelessly transmit the position detected by the at least one tilt sensor to the transmitting device.

18. The reusable transport container according to claim 17, wherein the at least one tilt sensor and the transmitting device are paired.

* * * * *